US010362428B2

(12) United States Patent
Chon et al.

(10) Patent No.: US 10,362,428 B2
(45) **Date of Patent: *Jul. 23, 2019**

(54) AUDIO APPARATUS AND AUDIO PROVIDING METHOD THEREOF

(71) Applicant: SAMSUNG ELECTRONICS CO., LTD., Suwon-si (KR)

(72) Inventors: Sang-bae Chon, Suwon-si (KR); Sun-min Kim, Suwon-si (KR); Hyun Jo, Seoul (KR); Jeong-su Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/990,053

(22) Filed: May 25, 2018

(65) Prior Publication Data

US 2018/0279064 A1 Sep. 27, 2018

Related U.S. Application Data

(63) Continuation of application No. 15/371,453, filed on Dec. 7, 2016, now Pat. No. 9,986,361, which is a (Continued)

(51) Int. Cl.
*H04S 7/00* (2006.01)
*H04S 5/00* (2006.01)
*H04S 3/00* (2006.01)

(52) U.S. Cl.
CPC ..... *H04S 7/302* (2013.01); *H04S 3/008* (2013.01); *H04S 5/005* (2013.01); (Continued)

(58) Field of Classification Search
CPC ..... H04S 1/00; H04S 7/302; H04S 2400/01; H04S 2420/01; H04R 5/04
(Continued)

(56) References Cited

U.S. PATENT DOCUMENTS 7,889,870 B2 2/2011 Chun
8,611,550 B2 12/2013 Del Galdo et al.
(Continued)

FOREIGN PATENT DOCUMENTS

CN 1829393 A 9/2006
CN 101001484 A 7/2007
(Continued)

OTHER PUBLICATIONS

Uhle, C., "Applause Sound Detection", Journal of Audio Eng. Soc., vol. 59, Issue No. 4, Apr. 2011, pp. 213-224.
(Continued)

*Primary Examiner* — Melur Ramakrishnaiah
(74) *Attorney, Agent, or Firm* — Sughrue Mion, PLLC

(57) ABSTRACT

An audio apparatus and an audio providing method thereof are provided. The audio providing method includes receiving an audio signal including a plurality of channels, applying an audio signal having a channel, from among the plurality of channels, giving a sense of elevation to a filter to generate a plurality of virtual audio signals to be respectively output to a plurality of speakers, applying a combination gain value and a delay value to the plurality of virtual audio signals so that the plurality of virtual audio signals respectively output through the plurality of speakers form a sound field having a plane wave, and respectively outputting the plurality of virtual audio signals, to which the combination gain value and the delay value are applied, through the plurality of speakers. The filter processes the audio signal to have a sense of elevation.

4 Claims, 26 Drawing Sheets

Related U.S. Application Data continuation of application No. 14/781,235, filed as application No. PCT/KR2014/002643 on Mar. 28, 2014, now Pat. No. 9,549,276.

(60) Provisional application No. 61/809,485, filed on Apr. 8, 2013, provisional application No. 61/806,654, filed on Mar. 29, 2013.

(52) U.S. Cl.
CPC ..... *H04S 2400/01* (2013.01); *H04S 2400/11* (2013.01); *H04S 2400/13* (2013.01); *H04S 2420/01* (2013.01)

(58) Field of Classification Search
USPC ..... 381/18, 300, 303, 17, 20, 22; 704/200.01, 500, 501, 502, 503
See application file for complete search history.

(56) References Cited

U.S. PATENT DOCUMENTS

| | | | | |
|---|---|---|---|---|
| 8,620,012 | B2 | 12/2013 | Kim | |
| 8,665,321 | B2 | 3/2014 | Choi et al. | |
| 9,536,529 | B2 | 1/2017 | Oh | |
| 2006/0198527 | A1 | 9/2006 | Chun | |
| 2006/0241797 | A1 | 10/2006 | Craig et al. | |
| 2007/0133831 | A1 | 6/2007 | Kim et al. | |
| 2009/0252356 | A1 | 10/2009 | Goodwin | |
| 2010/0121647 | A1* | 5/2010 | Beack | G10L 19/008 704/500 |
| 2011/0081024 | A1 | 4/2011 | Soulodre | |
| 2012/0002024 | A1 | 1/2012 | Choi et al. | |
| 2012/0008789 | A1 | 1/2012 | Kim et al. | |
| 2012/0109645 | A1 | 5/2012 | Hallam et al. | |
| 2012/0314876 | A1 | 12/2012 | Vilkamo et al. | |
| 2013/0028424 | A1* | 1/2013 | Kim | H04S 1/002 381/17 |
| 2014/0064493 | A1 | 3/2014 | Kim | |
| 2014/0098962 | A1 | 4/2014 | Par | |

FOREIGN PATENT DOCUMENTS

| | | | |
|---|---|---|---|
| CN | 101161029 | A | 4/2008 |
| CN | 202353798 | U | 7/2012 |
| CN | 102696070 | A | 9/2012 |
| EP | 1 868 416 | A2 | 12/2007 |
| JP | 2011-119867 | A | 6/2011 |
| JP | 2012-124616 | A | 6/2012 |
| JP | 2012-156610 | A | 8/2012 |
| JP | 2013-048317 | A | 3/2013 |
| JP | 2013-533703 | A | 8/2013 |
| JP | 2016-129424 | A | 7/2016 |
| KR | 10-0677629 | B1 | 2/2007 |
| KR | 10-2007-0033860 | A | 3/2007 |
| KR | 10-2009-0054583 | A | 6/2009 |
| KR | 1020110052702 | A | 5/2011 |
| KR | 10-2012-0004909 | A | 1/2012 |
| KR | 10-2012-0029783 | A | 3/2012 |
| RU | 2010150762 | A | 6/2012 |
| WO | 2011/045751 | A1 | 4/2011 |
| WO | 2012/160472 | A1 | 11/2012 |

OTHER PUBLICATIONS

Communication dated Apr. 13, 2016, issued by the Australian Patent Office in counterpart Australian Application No. 2014244722.
Communication dated Apr. 3, 2017, issued by the Federal Service for Intellectual Property in counterpart Russian Patent Application No. 205146225.
Communication dated Aug. 18, 2016 issued by Australian Intellectual Property Office in counterpart Australian Application No. 2014244722.
Communication dated May 16, 2016, issued by the Korean Intellectual Property Office in counterpart Korean Application No. 10-2015-7022453.
Communication dated Oct. 14, 2016 issued by European Patent Office in counterpart European Application No. 14773799.3.
Communication dated Sep. 6, 2016 issued by Japanese Intellectual Property Office in counterpart Japanese Application No. 2015-562940.
International Search Report (PCT/ISA/210) dated Jul. 28, 2014, issued by the International Searching Authority in counterpart International Patent Application No. for PCT/KR2014/002643.
Laitinen, et al., "Reproducing Applause-Type Signals with Directional Audio Coding", Journal of Audio Eng. Soc., vol. 59, No. 1/2, Jan./Feb. 2011, pp. 29-43.
Communication dated Jul. 7, 2017, issued by the State Intellectual Property Office of the People's Republic of China in counterpart Chinese Patent Application No. 201480019359.1.
Communication dated Mar. 5, 2019, issued by the Japanese Patent Office in counterpart Japanese Application No. 2017-232041.

* cited by examiner

AUDIO APPARATUS AND AUDIO PROVIDING METHOD THEREOF

CROSS-REFERENCE TO RELATED PATENT APPLICATIONS

The present application is a Continuation Application of U.S. application Ser. No. 15/371,453, filed on Dec. 7, 2016, which claims priority from U.S. application Ser. No. 14/781,235, filed on Sep. 29, 2015, now U.S. Pat. No. 9,549,276 issued Jan. 17, 2017, which is a national stage application under 35 U.S.C. § 371 of International Application No. PCT/KR2014/002643, filed on Mar. 28, 2014, which claims the benefit of U.S. Provisional Application No. 61/806,654, filed on Mar. 29, 2013, and U.S. Provisional Application No. 61/809,485, filed on Apr. 8, 2013, the disclosures of which are incorporated by reference in their entireties.

BACKGROUND

1. Field

Apparatuses and methods consistent with exemplary embodiments relate to an audio apparatus and an audio providing method thereof, and more particularly, to an audio apparatus and an audio providing method in which virtual audio that gives a sense of elevation is generated and provided by using a plurality of speakers located on a same plane.

2. Description of Related Art

Due to advances in video and sound processing technology, content having high image quality and high sound quality is widely available. Therefore, users would like content having high image quality and high sound quality with realistic video and audio.

3D audio is a technology in which a plurality of speakers are located at different positions on a horizontal plane and output the same audio signal or different audio signals, thereby enabling a user to perceive a sense of space. However, actual audio is provided at various positions on a horizontal plane and is also provided at different heights. Therefore, a technology could be developed for effectively reproducing an audio signal provided at different heights.

In the related art, as illustrated in FIG. 1A, an audio signal is filtered by a tone color conversion filter (for example, a head related transfer filter (HRTF) correction filter) corresponding to a first height, and a plurality of audio signals are generated by copying the filtered audio signal. A plurality of gain applying units respectively amplify or attenuate the generated plurality of audio signals, based on gain values respectively corresponding to a plurality of speakers through which the generated plurality of audio signals are to be output, and amplified or attenuated sound signals are respectively output through corresponding speakers. Accordingly, virtual audio giving a sense of elevation may be generated by using a plurality of speakers located on the same plane.

However, in a virtual audio signal generating method of the related art, a sweet spot is narrow, and for this reason, in the case of actually reproducing audio through a system, the performance is limited. That is, in the related art, as illustrated in FIG. 1B, because audio is optimized and rendered at one point only (for example, a region 0 located in the center), a user cannot normally listen to a virtual audio signal giving a sense of elevation in a region (for example, a region X located leftward from the center) instead of the one point.

SUMMARY

According to an aspect of an exemplary embodiment, there is provided an audio providing method performed by an audio apparatus, the audio providing method including: receiving an audio signal including a plurality of audio channels; generating a plurality of virtual audio signals by applying an audio signal of an audio channel among the plurality of audio channels to a filter configured to process the audio signal to sound like the audio signal is generated at a height that is different than a height of a plurality of speakers located on a horizontal plane; applying a combination gain value and a delay value to the plurality of virtual audio signals so that the plurality of virtual audio signals form a sound field having a plane wave; and respectively outputting the plane wave of the plurality of virtual audio signals through the plurality of speakers.

The generating may include: copying the filtered audio signal to generate a number of filtered audio signals corresponding to a number of the speakers, wherein the generating the plurality of virtual audio signals may include applying a panning gain value to each of the copied filtered audio signals so that the copied filtered audio signals sound like they are generated at a height that is different than a height of the plurality of speakers located on a horizontal plane.

The applying may include: multiplying the plurality of virtual audio signals by the combination gain value and applying the delay value to virtual audio signals corresponding to at least two speakers, among the plurality of speakers, for implementing the sound field having the plane wave.

The applying may further include applying a gain value of 0 to an audio signal corresponding to each speaker among the plurality of speakers except the at least two speakers among the plurality of speakers.

The applying further may include: applying the delay value to the plurality of virtual audio signals respectively corresponding to the plurality of speakers; and multiplying the plurality of virtual audio signals by a final gain value obtained by multiplying the panning gain value and the combination gain value.

The filter may be a head related transfer filter (HRTF).

The outputting may include mixing a virtual audio signal that corresponds to a specific audio channel with an audio signal having the specific audio channel to output an audio signal, obtained through the mixing, through a speaker corresponding to the specific audio channel.

According to an aspect of another exemplary embodiment, there is provided an audio apparatus including: an input interface configured to receive an audio signal including a plurality of audio channels; a virtual audio generator configured to apply an audio signal of an audio channel among the plurality of audio channels to a filter configured to process the audio signal to sound like the audio signal is generated at a height that is different than a height of a plurality of speakers located on a horizontal plane; a virtual audio processor configured to apply a combination gain value and a delay value to the plurality of virtual audio signals so that the plurality of virtual audio signals form a sound field having a plane wave; and an output interface configured to respectively output the plane wave of the plurality of virtual audio signals through the plurality of speakers.

The virtual audio processor may be further configured to copy the filtered audio signal to generate a number of filtered audio signals corresponding to a number of the speakers and apply a panning gain value to each of the copied filtered audio signals so that the copied filtered audio signals sound like they are generated at a height that is different than a height of the plurality of speakers located on a horizontal plane.

The virtual audio processor may be further configured to multiply the plurality of virtual audio signals by the combination gain value and apply the delay value to virtual audio signals corresponding to at least two speakers among the plurality of speakers, for implementing the sound field having the plane wave.

The virtual audio processor may be further configured to apply a gain value of 0 to an audio signal corresponding to each speaker among the plurality of speakers except the at least two speakers among the plurality of speakers.

The virtual audio processor may be further configured to apply the delay value to the plurality of virtual audio signals respectively corresponding to the plurality of speakers, and multiply the plurality of virtual audio signals by a final gain value obtained by multiplying the panning gain value and the combination gain value.

The filter may be a head related transfer filter (HRTF).

The output interface may be further configured to mix a virtual audio signal that corresponds to a specific audio channel with an audio signal having the specific audio channel to output an audio signal, obtained through the mixing, through a speaker corresponding to the specific audio channel.

According to an aspect of another exemplary embodiment, there is provided an audio providing method performed by an audio apparatus, the audio providing method including: receiving an audio signal including a plurality of audio channels; applying an audio signal having an audio channel among the plurality of audio channels to a filter configured to process the audio signal to sound like the audio signal is generated at a height that is different than a height of a plurality of speakers located on a horizontal plane; generating a plurality of virtual audio signals by applying different gain values to the audio signal corresponding to a frequency, based on information of an audio channel of an audio signal from which a virtual audio signal is to be generated; and respectively outputting the plurality of virtual audio signals through the plurality of speakers.

Information of the audio channel of the audio signal may include at least one of information about whether an input audio signal is an audio signal having impulsive characteristic, information about whether the input audio signal is an audio signal having a wideband, and information about whether the input audio signal is low in inter-channel cross correlation (ICC).

According to an aspect of another exemplary embodiment, there is provided an audio apparatus including: an applause detector configured to determine whether applause is detected from an audio signal; a spatial renderer configured to perform spatial rendering on the audio signal; a timbral renderer configured to perform timbral rendering on the audio signal; and a rendering analyzer configured to determine whether to use spatial rendering or timbral rendering according to a component of the applause.

The spatial renderer may be further configured to receive signals corresponding to objects localized to each of a plurality of audio signals.

The spatial renderer may be further configured to receive a dried channel sound source and the timbral renderer may be configured to receive a diffused channel sound source.

The rendering analyzer may further include a frequency converter configured to convert input signals into frequency domains.

DETAILED DESCRIPTION OF EXEMPLARY EMBODIMENTS

Figure 1A:
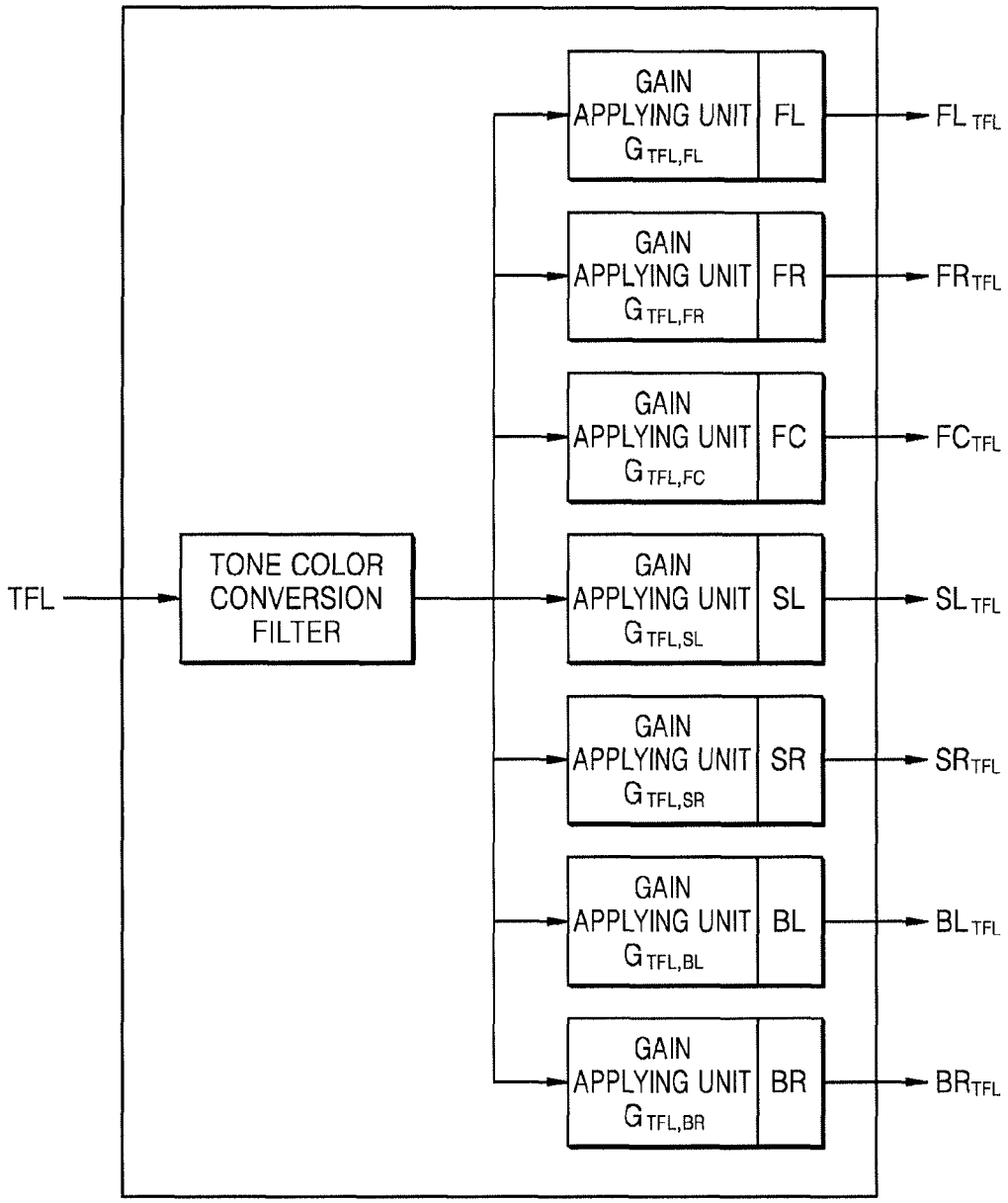
FIGS. 1A and 1B are diagrams illustrating a virtual audio providing method of the related art.
Figure 1B:
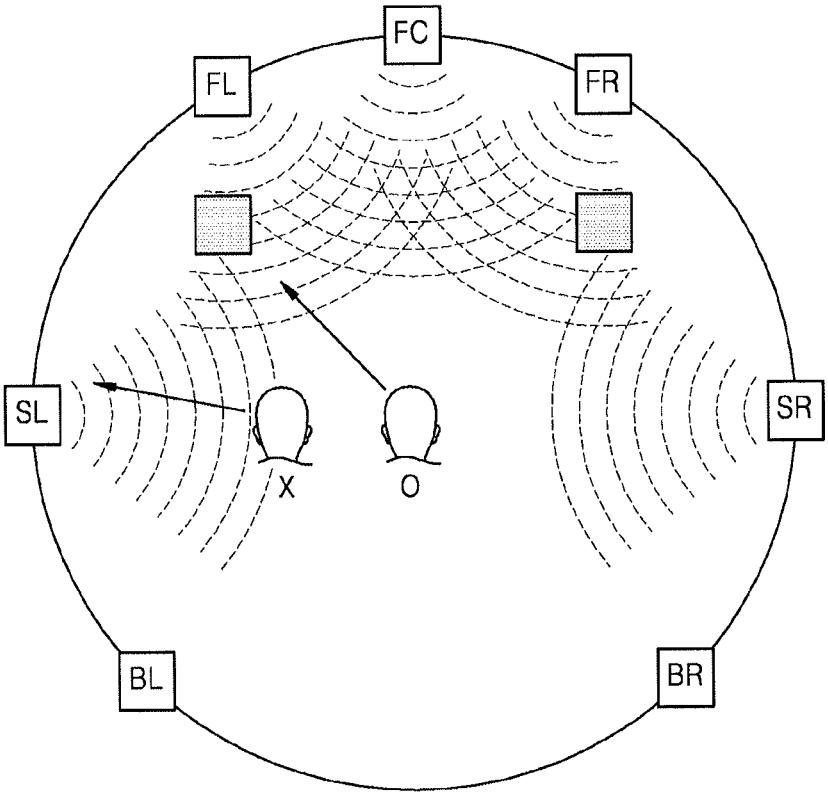

Below, one or more exemplary embodiments will be described with reference to the accompanying drawings. Exemplary embodiments may, however, be embodied in many different forms and should not be construed as being limited to exemplary embodiments set forth herein. However, this does not limit the present disclosure and it should be understood that the present disclosure covers all modifications, equivalents, and replacements within the idea and technical scope of the inventive concept. Like reference numerals refer to like elements throughout.

It will be understood that although the terms including an ordinal number such as first or second may be used to describe various elements, these elements should not be limited by these terms. The terms first and second should not be used to attach any order of importance but are used to distinguish one element from another element.

Below, technical terms may be used for explaining one or more exemplary embodiments without limiting the scope. Terms of a singular form may include plural forms unless otherwise stated. Unless otherwise defined, all terms (including technical and scientific terms) used herein have a meaning as commonly understood by one of ordinary skill in the art. It will be further understood that terms may be interpreted as having a meaning that is consistent with their meaning in the context of the relevant art and will not be interpreted in an idealized or overly formal sense unless expressly so defined herein.

According to one or more exemplary embodiments, ". . . module" or ". . . unit" described herein performs at least one function or operation, and may be implemented in hardware, software or a combination of hardware and software. Also, a plurality of ". . . modules" or a plurality of ". . . units" may be integrated as at least one module and thus implemented with at least one processor, except for ". . . module" or ". . . unit" that is implemented with specific hardware.

Below, one or more exemplary embodiments will be described in detail with reference to the accompanying drawings. Like numbers refer to like elements throughout the description of the figures.

Figure 2:
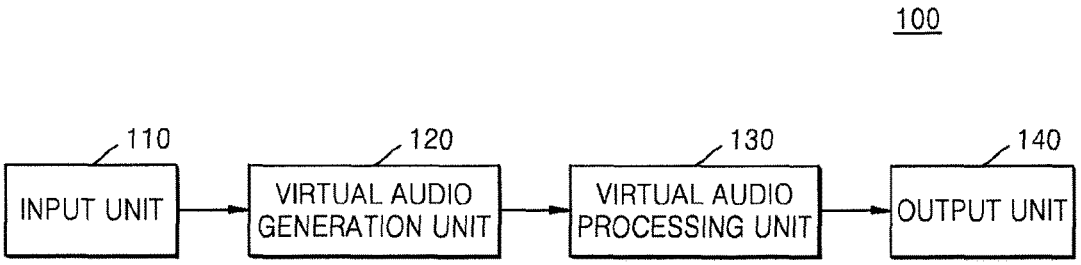
FIG. 2 is a block diagram illustrating a configuration of an audio apparatus according to an exemplary embodiment.

FIG. 2 is a block diagram illustrating a configuration of an audio apparatus 100 according to an exemplary embodiment. As illustrated in FIG. 2, the audio apparatus 100 may include an input unit 110 (e.g., input interface), a virtual audio generation unit 120 (e.g., virtual audio generator), a virtual audio processing unit 130 (e.g., virtual audio processor), and an output unit 140 (e.g., output interface). According to an exemplary embodiment, the audio apparatus 100 may include a plurality of speakers, which may be located on the same horizontal plane.

The input unit 110 may receive an audio signal including a plurality of channels. The input unit 110 may receive the audio signal including the plurality of channels giving different senses of elevation. For example, the input unit 110 may receive 11.1-channel audio signals.

The virtual audio generation unit 120 may apply an audio signal, which has a channel giving a sense of elevation among a plurality of channels, to a tone color conversion filter which processes an audio signal to have a sense of elevation (i.e., to sound like the audio signal is generated at a height that is different than a height of a plurality of speakers located on a horizontal plane), thereby generating a plurality of virtual audio signals which is to be output through a plurality of speakers. The virtual audio generation unit 120 may use an HRTF correction filter for modeling a sound, which is generated at an elevation higher than actual positions of a plurality of speakers located on a horizontal plane, by using the speakers. The HRTF correction filter may include information (i.e., frequency transfer characteristic) of a path from a spatial position of a sound source to two ears of a user. The HRTF correction filter may recognize a 3D sound according to a phenomenon in which a characteristic of a complicated path such as reflection by auricles is changed depending on a transfer direction of a sound, in addition to an inter-aural level difference (ILD) and an inter-aural time difference (ITD) which occurs when a sound reaches two ears, etc. Because the HRTF correction filter has a unique characteristic in an angular direction of a space, the HRTF correction filter may generate a 3D sound by using the unique characteristic.

For example, when the 11.1-channel audio signals are input, the virtual audio generation unit 120 may apply an audio signal, which has a top front left channel among the 11.1-channel audio signals, to the HRTF correction filter to generate seven audio signals which are to be output through a plurality of speakers having a 7.1-channel layout.

According to an exemplary embodiment, the virtual audio generation unit 120 may copy an audio signal obtained through filtering by the tone color conversion filter to correspond to the number of speakers and may respectively apply panning gain values, respectively corresponding to the speakers, to audio signals which are obtained through the copy for the audio signal to have a virtual sense of elevation, thereby generating a plurality of virtual audio signals. According to another exemplary embodiment, the virtual audio generation unit 120 may copy an audio signal obtained through filtering by the tone color conversion filter to correspond to the number of speakers, thereby generating a plurality of virtual audio signals. The panning gain values may be applied by the virtual audio processing unit 130.

Figure 3:
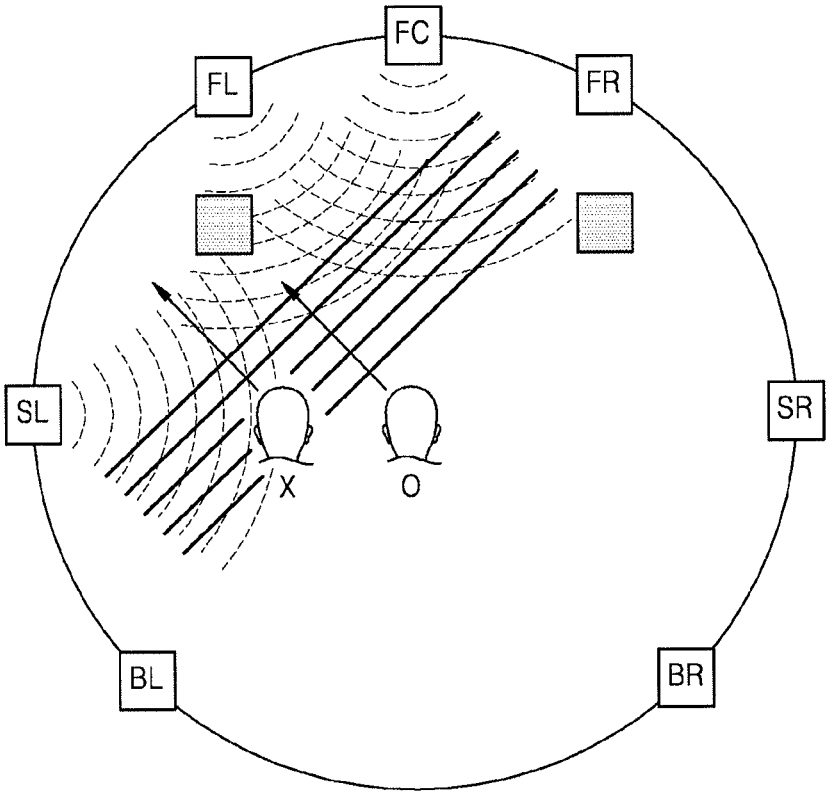
FIG. 3 is a diagram illustrating virtual audio having a plane-wave sound field according to an exemplary embodiment.

The virtual audio processing unit 130 may apply a combination gain value and a delay value to a plurality of virtual audio signals for the plurality of virtual audio signals, which are output through a plurality of speakers, to constitute a sound field having a plane wave. As illustrated in FIG. 3, the virtual audio processing unit 130 may generate a virtual audio signal to constitute a sound field having a plane wave instead of a sweet spot being generated at one point, thereby enabling a user to listen to the virtual audio signal at various points.

According to an exemplary embodiment, the virtual audio processing unit 130 may multiply a virtual audio signal, corresponding to at least two speakers for implementing a sound field having a plane wave among a plurality of speakers, by the combination gain value and may apply the delay value to the virtual audio signal corresponding to the at least two speakers. The virtual audio processing unit 130 may apply a gain value "0" to an audio signal corresponding to a speaker except at least two of a plurality of speakers. For example, the virtual audio generation unit 120 generates seven virtual audio signals to generate a 11.1-channel audio signal, corresponding to the top front left channel, as a virtual audio signal and in implementing a signal $FL_{TFL}$ which is to be reproduced as a signal corresponding to a front left channel among the generated seven virtual audio signals. The virtual audio processing unit 130 may multiply, by the combination gain value, virtual audio signals respectively corresponding to a front center channel, a front left channel, and a surround left channel among a plurality of 7.1-channel speakers and may apply the delay value to the audio signals to process a plurality of virtual audio signals which are to be output through speakers respectively corresponding to the front center channel, the front left channel, and the surround left channel. Also, in implementing the signal $FL_{TFL}$, the virtual audio processing unit 130 may multiply, by a combination gain value "0", virtual audio signals respectively corresponding to a front right channel, a surround right channel, a back left channel, and a back right channel which are contralateral channels in the 7.1-channel speakers.

According to another exemplary embodiment, the virtual audio processing unit 130 may apply the delay value to a plurality of virtual audio signals respectively corresponding to a plurality of speakers and may apply a final gain value, which is obtained by multiplying a panning gain value and the combination gain value, to the plurality of virtual audio signals to which the delay value is applied, thereby generating a sound field having a plane wave.

The output unit 140 may output the processed plurality of virtual audio signals through speakers corresponding thereto. The output unit 140 may mix a virtual audio signal corresponding to a channel with an audio signal having the channel to output an audio signal, obtained through the mixing, through a speaker corresponding to the channel. For example, the output unit 140 may mix a virtual audio signal corresponding to the front left channel with an audio signal, which is generated by processing the top front left channel, to output an audio signal, obtained through the mixing, through a speaker corresponding to the front left channel.

The audio apparatus 100 enables a user to listen to a virtual audio signal giving a sense of elevation, provided by the audio apparatus 100, at various positions.

Below, a method of rendering a 11.1-channel audio signal to a virtual audio signal to output, through a 7.1-channel speaker, an audio signal corresponding to each of channels giving different senses of elevation among 11.1-channel audio signals, according to an exemplary embodiment, will be described with reference to FIGS. 4 to 7.

Figure 4:
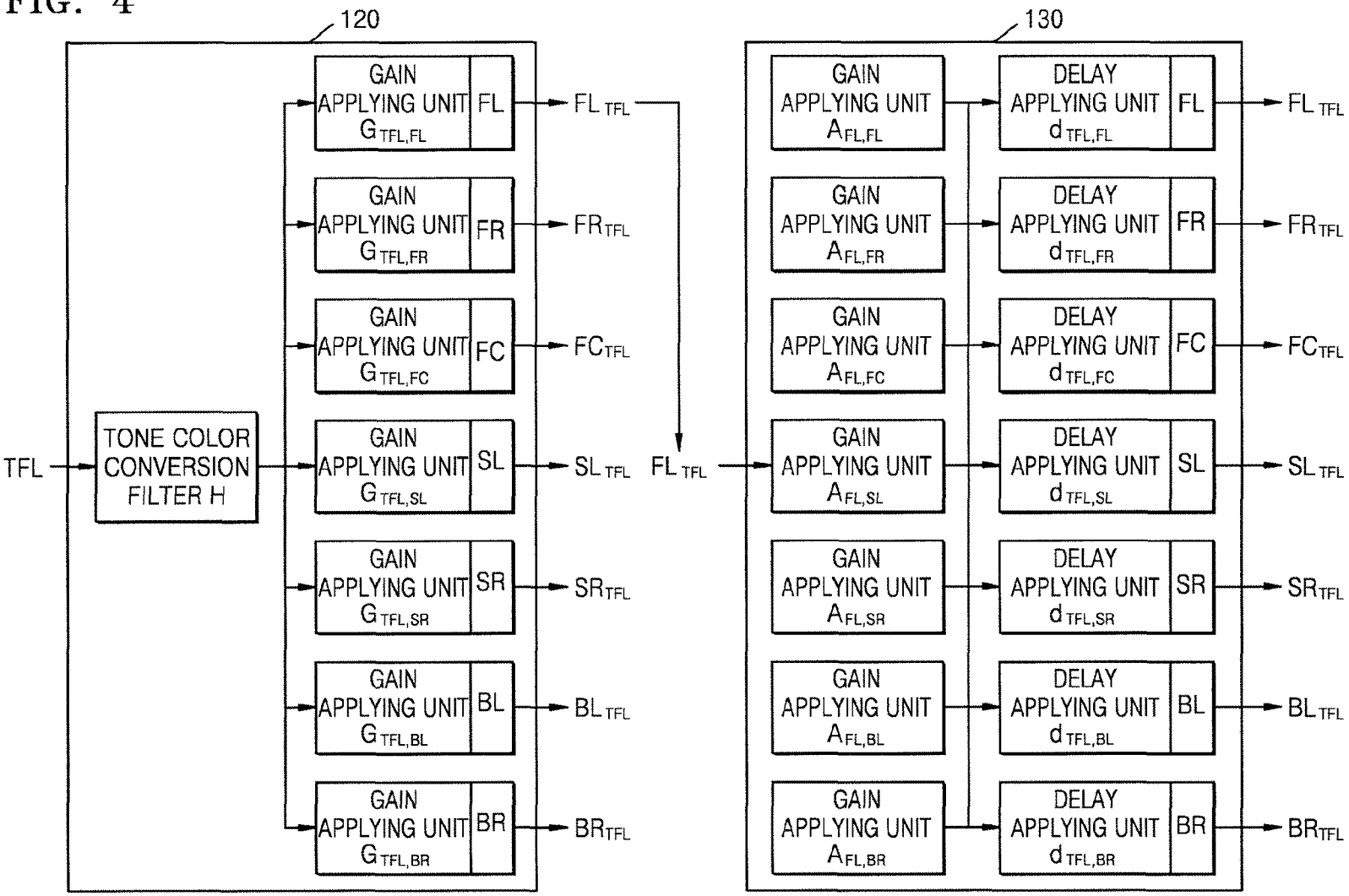
FIGS. 4 to 7 are diagrams illustrating a method of rendering a 11.1-channel audio signal to output the rendered audio signal through a 7.1-channel speaker, according to one or more exemplary embodiments.

FIG. 4 is a diagram illustrating a method of rendering a 11.1-channel audio signal having the top front left channel to a virtual audio signal to output the virtual audio signal through a 7.1-channel speaker, according to one or more exemplary embodiments.

First, when the 11.1-channel audio signal having the top front left channel is input, the virtual audio generation unit 120 may apply the input audio signal having the top front left channel to a tone color conversion filter H. Also, the virtual audio generation unit 120 may copy an audio signal, corresponding to the top front left channel to which the tone color conversion filter H is applied, to seven audio signals and then may respectively input the seven audio signals to a plurality of gain applying units respectively corresponding to 7-channel speakers. In the virtual audio generation unit 120, seven gain applying units may multiply a tone color converted audio signal by 7-channel panning gains "$G_{TFL,FL}$, $G_{TFL,FR}$, $G_{TFL,FC}$, $G_{TFL,SL}$, $G_{TFL,SR}$, $G_{TFL,BL}$, and $G_{TFL,BR}$" to generate 7-channel virtual audio signals.

Moreover, the virtual audio processing unit 130 may multiply a virtual audio signal of input 7-channel virtual audio signals, corresponding to at least two speakers for implementing a sound field having a plane wave among a plurality of speakers, by a combination gain value and may apply a delay value to the virtual audio signal corresponding to the at least two speakers. As illustrated in FIG. 3, when converting an audio signal having the front left channel into a plane wave which is input at a specific-angle (e.g., 30 degrees) position, the virtual audio processing unit 130 may multiply an audio signal by combination gain values "$A_{FL,FL}$, $A_{FL,FC}$, and $A_{FL,SL}$" for plane wave combination by using speakers, which have the front left channel, the front center channel, the surround left channel and are speakers located on the same half plane (for example, a left half plane and a center in a left signal, and in a right signal, a right half plane and the center) as an incident direction and may apply delay values "$d_{TFL,FL}$, $d_{TFL,FC}$, and $d_{TFL,SL}$" to a signal obtained through the multiplication to generate a virtual audio signal having the forms of plane waves. This may be expressed as the following Equation:

$$FL_{TFL,FL}=A_{FL,FL}SFL_{TFL}(n-d_{TFL,FL})=A_{FL,FL}SG_{TFL,FL}SH*TFL(n-d_{TFL,FL})$$

$$FC_{TFL,FL}=A_{FL,FC}SFL_{TFL}(n-d_{TFL,FC})=A_{FL,FC}SG_{TFL,FL}SH*TFL(n-d_{TFL,FC})$$

$$SL_{TFL,FL}=A_{FL,SL}SFL_{TFL}(n-d_{TFL,SL})=A_{FL,SL}SG_{TFL,FL}SH*TFL(n-d_{TFL,SL})$$

Moreover, the virtual audio processing unit 130 may set, to 0, combination gain values "$A_{FL,FR}$, $A_{FL,SR}$, $A_{FL,BL}$, and $A_{FL,BR}$" of virtual audio signals output through speakers which have the front right channel, the surround right channel, the back right channel, and the back left channel and may not be located on the same half plane as the incident direction.

Therefore, as illustrated in FIG. 4, the virtual audio processing unit 130 may generate seven virtual audio signals "$FL_{TFL}$, $FR_{TFL}$, $FC_{TFL}$, $SL_{TFL}$, $SR_{TFL}$, $BL_{TFL}$, and $BR_{TFL}$" for implementing a plane wave.

In FIG. 4, it is illustrated that the virtual audio generation unit 120 multiplies an audio signal by a panning gain value and the virtual audio processing unit 130 multiplies the audio signal by a combination gain value. According to one or more exemplary embodiments, the virtual audio processing unit 130 may multiply an audio signal by a final gain value obtained by multiplying the panning gain value and the combination gain value.

Figure 5:
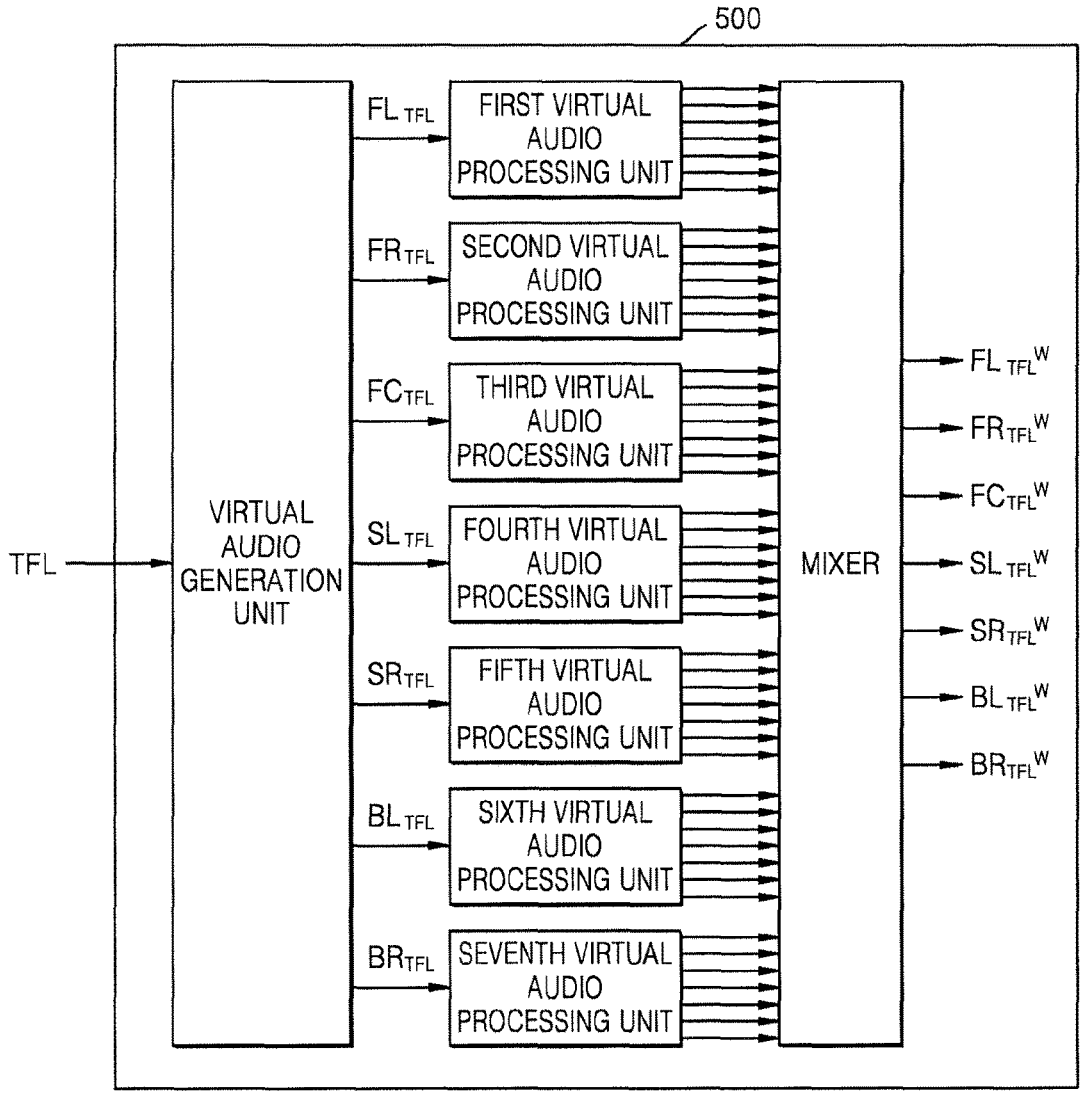

As illustrated in the audio apparatus 500 in FIG. 5, the virtual audio signals may respectively be processed by seven virtual audio processing units, and processed by a mixer, resulting in the mixed audio signals "$FL_{TFL}^{W}$, $FR_{TFL}^{W}$, $FC_{TFL}^{W}$, $SL_{TFL}^{W}$, $SR_{TFL}^{W}$, $BL_{TFL}^{W}$, and $BR_{TFL}^{W}$".

Figure 6:
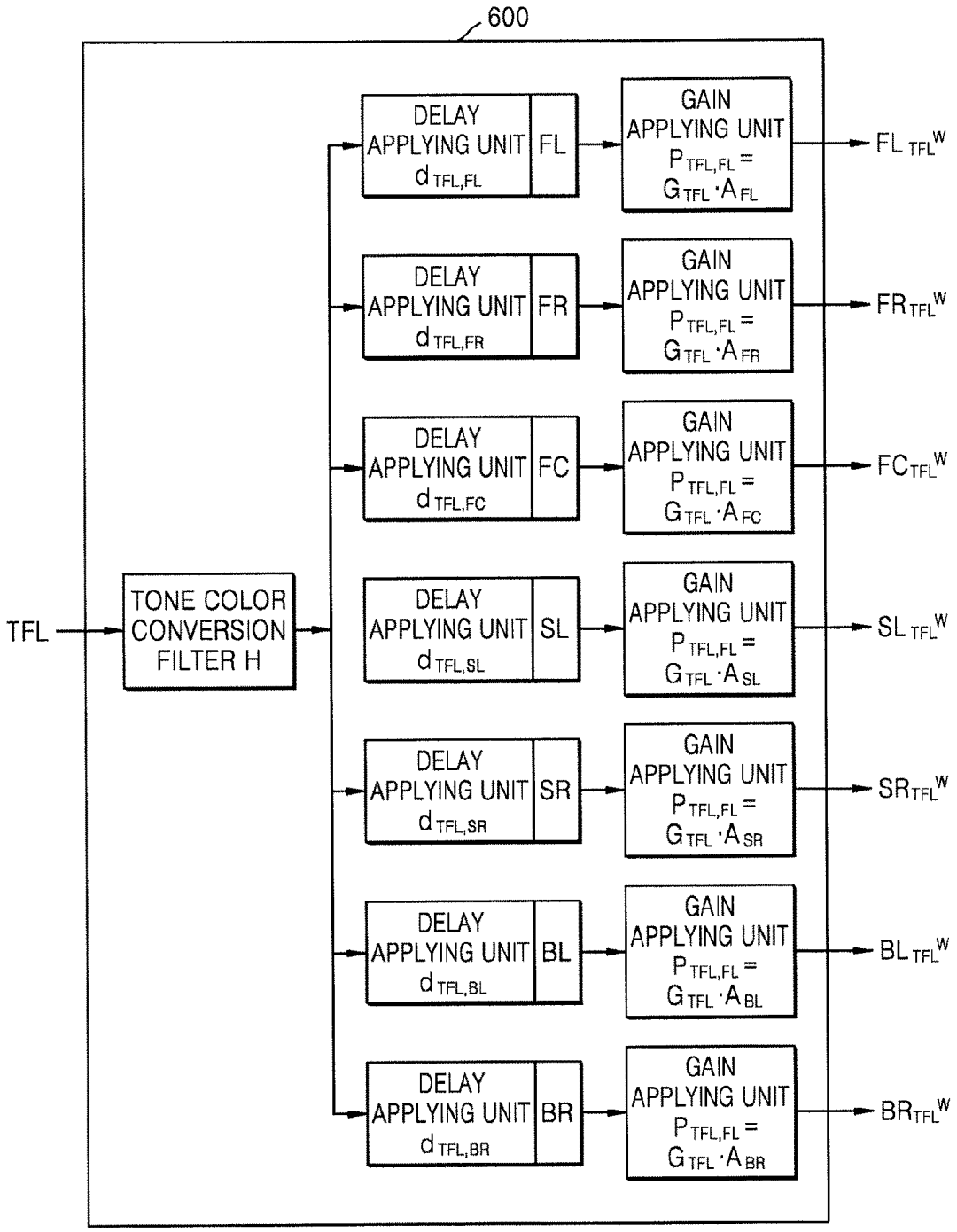

As illustrated in FIG. 6, the virtual audio processing unit 600 may apply a delay value to a plurality of virtual audio signals of which tone colors are converted by the tone color conversion filter H and then may apply a final gain value to the virtual audio signals with the delay value applied thereto to generate a plurality of virtual audio signals having a sound field having the form of plane waves. The virtual audio processing unit 130 may integrate panning gain values "G" of the gain applying units of the virtual audio generation unit 120 of FIG. 4 and combination gain values "A" of the gain applying units of the virtual audio processing unit 130 of FIG. 4 to calculate a final gain value "$P_{TFL,FL}$". This may be expressed as the following Equation:

$$\begin{aligned} FL_{TFL}^{W} &= \underset{@s}{Q}FL_{TFL,s} \\ &= \underset{@s}{Q}A_{s,FL}sG_{TFL,s}sH*TFL(n-d_{TFL,FL}) \\ &= H*RFLs(n-d_{TFLL,FL})\underset{@s}{Q}A_{s,FL}sG_{TFL,sL} \\ &= H*RFLs(n-d_{TFL,FL})P_{TFL,FL} \end{aligned}$$

in which s denotes an element of S={FL, FR, FC, SL, SR, BL, BR}.

In FIGS. 4 to 6, an exemplary embodiment in which an audio signal corresponding to the top front left channel among 11.1-channel audio signals is rendered to a virtual audio signal has been described above, but audio signals respectively corresponding to a top front right channel, a top surround left channel, and a top surround right channel giving different senses of elevation among the 11.1-channel audio signals may be rendered by the above-described method.

Figure 7:
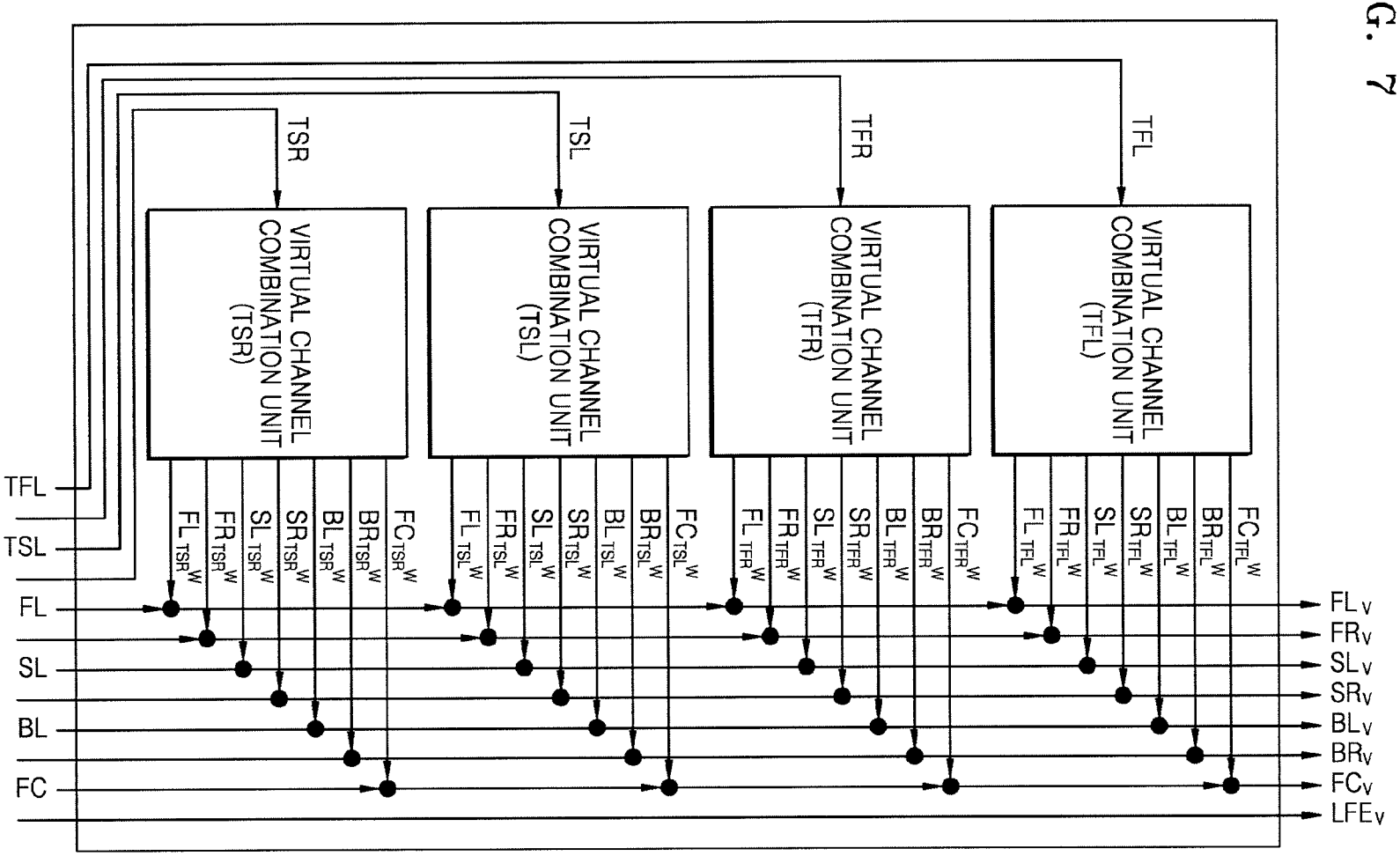

As illustrated in FIG. 7, audio signals respectively corresponding to a top front left channel, the top front right channel, the top surround left channel, and the top surround right channel may be respectively rendered to a plurality of virtual audio signals by a plurality of virtual channel combination units which include the virtual audio generation unit 120 and the virtual audio processing unit 130, and the plurality of virtual audio signals obtained through the rendering may be mixed with audio signals respectively corresponding to 7.1-channel speakers and output.

Figure 8:
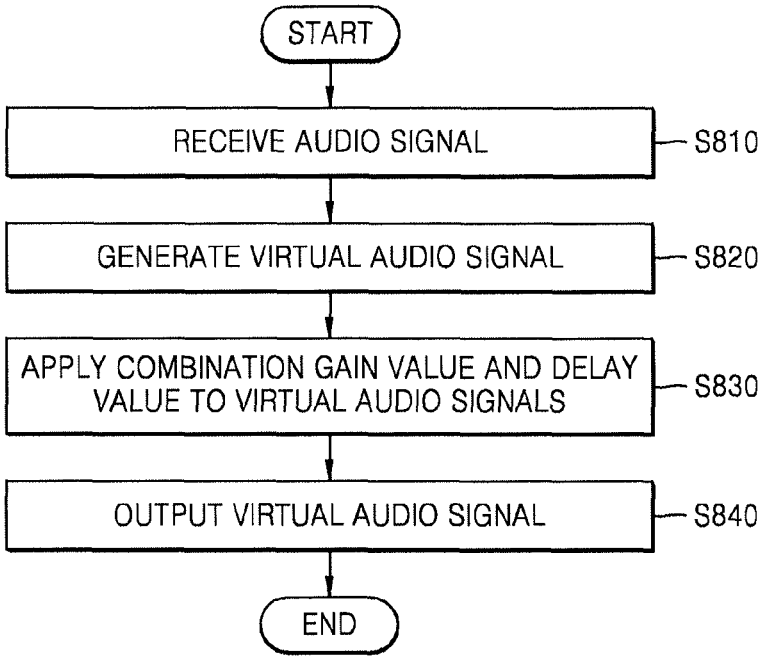
FIG. 8 is a diagram illustrating an audio providing method performed by an audio apparatus, according to an exemplary embodiment.

FIG. 8 is a diagram illustrating an audio providing method performed by the audio apparatus 100, according to an exemplary embodiment.

In operation S810, the audio apparatus 100 may receive an audio signal. The received audio signal may be a multi-channel audio signal (e.g., 11.1 channel) giving plural senses of elevation.

In operation S820, the audio apparatus 100 may apply an audio signal, having a channel giving a sense of elevation among a plurality of channels, to the tone color conversion filter which processes an audio signal to have a sense of elevation, thereby generating a plurality of virtual audio signals which are to be output through a plurality of speakers.

In operation S830, the audio apparatus 100 may apply a combination gain value and a delay value to the generated plurality of virtual audio signals. The audio apparatus 100 may apply the combination gain value and the delay value to the plurality of virtual audio signals for the plurality of virtual audio signals to have a plane-wave sound field.

In operation S840, the audio apparatus 100 may respectively output the generated plurality of virtual audio signals to the plurality of speakers.

As described above, the audio apparatus 100 may apply the delay value and the combination gain value to a plurality of virtual audio signals to render a virtual audio signal having a plane-wave sound field. Thus, a user listens to a virtual audio signal giving a sense of elevation, provided by the audio apparatus 100, at various positions.

According to an exemplary embodiment, for a user to listen to a virtual audio signal giving a sense of elevation at various positions instead of one point, the virtual audio signal may be processed to have a plane-wave sound field. According to one or more exemplary embodiments, for a user to listen to a virtual audio signal giving a sense of elevation at various positions, the virtual audio signal may be processed by another method. The audio apparatus 100 may apply different gain values to audio signals according to a frequency, based on the kind of a channel of an audio signal from which a virtual audio signal is to be generated, thereby enabling a user to listen to a virtual audio signal in various regions.

Figure 9:
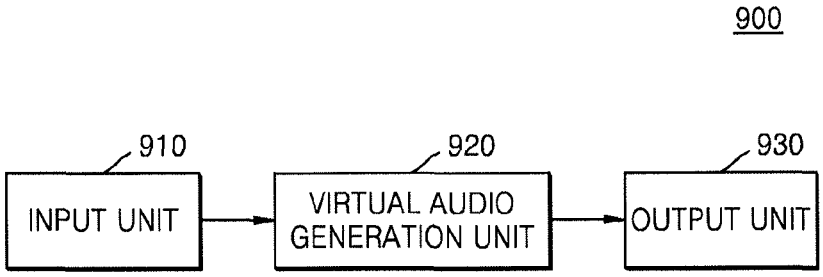
FIG. 9 is a block diagram illustrating a configuration of an audio apparatus according to another exemplary embodiment.

Below, a virtual audio signal providing method according to another exemplary embodiment will be described with reference to FIGS. 9 to 12. FIG. 9 is a block diagram illustrating a configuration of an audio apparatus 900 according to another exemplary embodiment. The audio apparatus 900 may include an input unit 910, a virtual audio generation unit 920, and an output unit 930.

The input unit 910 may receive an audio signal including a plurality of channels. The input unit 910 may receive the audio signal including the plurality of channels giving different senses of elevation. For example, the input unit 910 may receive a 11.1-channel audio signal.

The virtual audio generation unit 920 may apply an audio signal, which has a channel giving a sense of elevation among a plurality of channels, to a filter which processes an audio signal to have a sense of elevation, and may apply different gain values to the audio signal according to a frequency, based on the kind of a channel of an audio signal from which a virtual audio signal is to be generated, thereby generating a plurality of virtual audio signals.

The virtual audio generation unit 920 may copy a filtered audio signal to correspond to the number of speakers and may determine an ipsilateral speaker and a contralateral speaker, based on the kind of a channel of an audio signal from which a virtual audio signal is to be generated. The virtual audio generation unit 920 may determine, as an ipsilateral speaker, a speaker located in the same direction and may determine, as a contralateral speaker, a speaker located in an opposite direction, based on the kind of a channel of an audio signal from which a virtual audio signal is to be generated. For example, when an audio signal from which a virtual audio signal is to be generated is an audio signal having the top front left channel, the virtual audio generation unit 920 may determine, as ipsilateral speakers, speakers respectively corresponding to the front left channel, the surround left channel, and the back left channel located in the same direction as or a direction closest to that of the top front left channel, and may determine, as contralateral speakers, speakers respectively corresponding to the front right channel, the surround right channel, and the back right channel located in a direction opposite to that of the top front left channel.

Moreover, the virtual audio generation unit 920 may apply a low band boost filter to a virtual audio signal corresponding to an ipsilateral speaker and may apply a high-pass filter to a virtual audio signal corresponding to a contralateral speaker. The virtual audio generation unit 920 may apply the low band boost filter to the virtual audio signal corresponding to the ipsilateral speaker for adjusting a whole tone color balance and may apply the high-pass filter, which filters a high frequency domain affecting sound image localization, to the virtual audio signal corresponding to the contralateral speaker.

A low frequency component of an audio signal largely affects sound image localization based on ITD, and a high frequency component of the audio signal largely affects sound image localization based on ILD. When a listener moves in one direction, in the ILD, a panning gain may be effectively set, and by adjusting a degree to which a left sound source moves to the right or a right sound source moves to the left, the listener continuously listens to a smoot audio signal. However, in the ITD, a sound from a close speaker is first heard by ears, and thus, when the listener moves, left-right localization reversal occurs.

The left-right localization reversal may be solved in sound image localization. The virtual audio processing unit 920 may remove a low frequency component that affects the ITD in virtual audio signals corresponding to contralateral speakers located in a direction opposite to a sound source, and may filter a high frequency component that dominantly affects the ILD. Therefore, the left-right localization reversal caused by the low frequency component is prevented, and a position of a sound image may be maintained by the ILD based on the high frequency component.

Moreover, the virtual audio generation unit 920 may multiply, by a panning gain value, an audio signal corresponding to an ipsilateral speaker and an audio signal corresponding to a contralateral speaker to generate a plurality of virtual audio signals. The virtual audio generation unit 920 may multiply, by a panning gain value for sound image localization, an audio signal which corresponds to an ipsilateral speaker and passes through the low band boost filter and an audio signal which corresponds to the contralateral speaker and passes through the high-pass filter, thereby generating a plurality of virtual audio signals. That is, the virtual audio generation unit 920 may apply different gain values to an audio signal according to frequencies of a plurality of virtual audio signals to generate the plurality of virtual audio signals, based on a position of a sound image.

The output unit 930 may output a plurality of virtual audio signals through speakers corresponding thereto. The output unit 930 may mix a virtual audio signal corresponding to a channel with an audio signal having the channel output an audio signal, obtained through the mixing, through a speaker corresponding to the channel. For example, the output unit 930 may mix a virtual audio signal corresponding to the front left channel with an audio signal, which is generated by processing the top front left channel, to output an audio signal, obtained through the mixing, through a speaker corresponding to the front left channel.

Below, a method of rendering a 11.1-channel audio signal to a virtual audio signal to output, through a 7.1-channel speaker, an audio signal corresponding to each of channels giving different senses of elevation among 11.1-channel audio signals, according to an exemplary embodiment, will be described with reference to FIG. 10.

Figure 10:
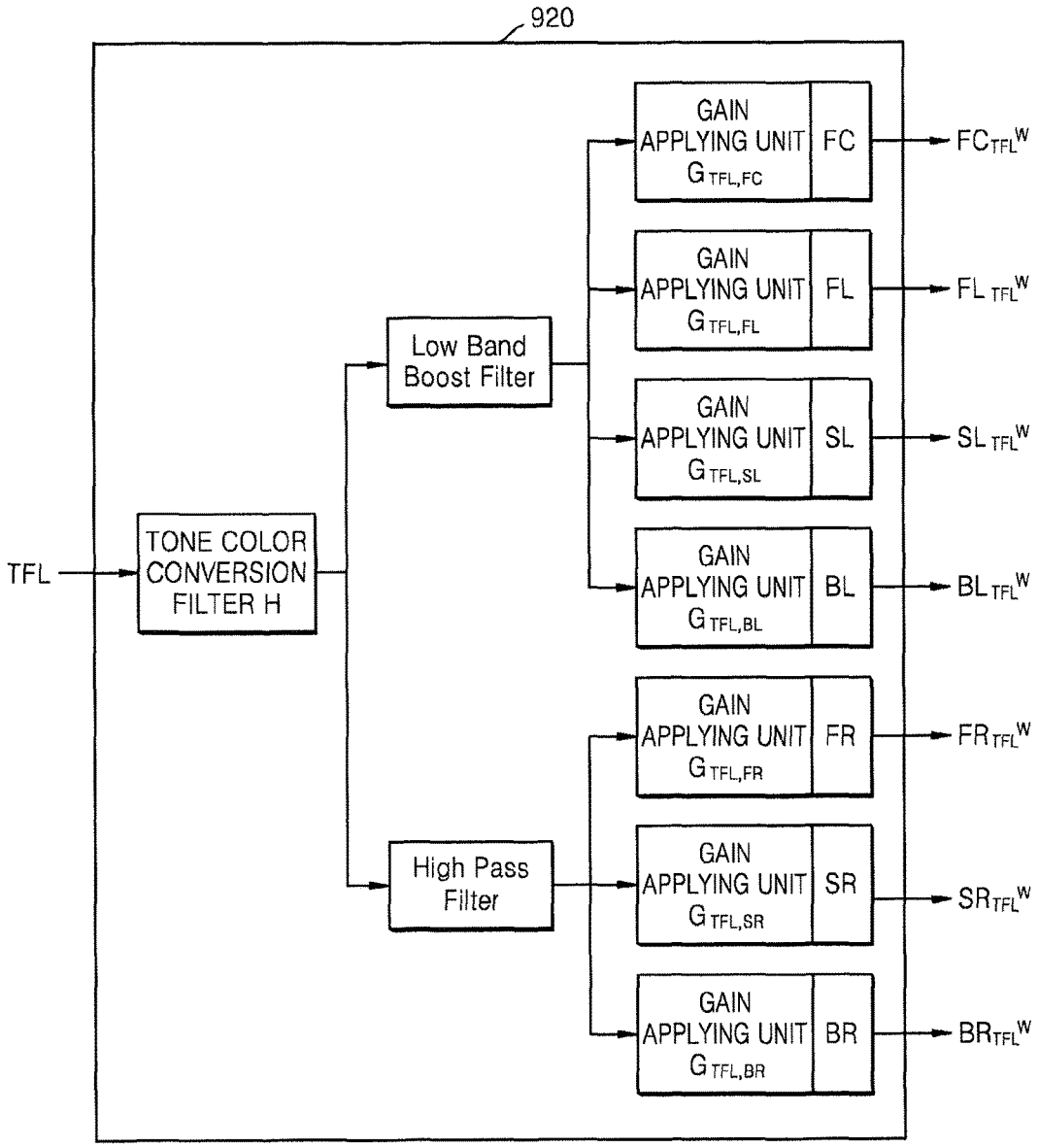
FIGS. 10 and 11 are diagrams illustrating a method of rendering a 11.1-channel audio signal to output the rendered audio signal through a 7.1-channel speaker, according to one or more exemplary embodiments.
Figure 11:
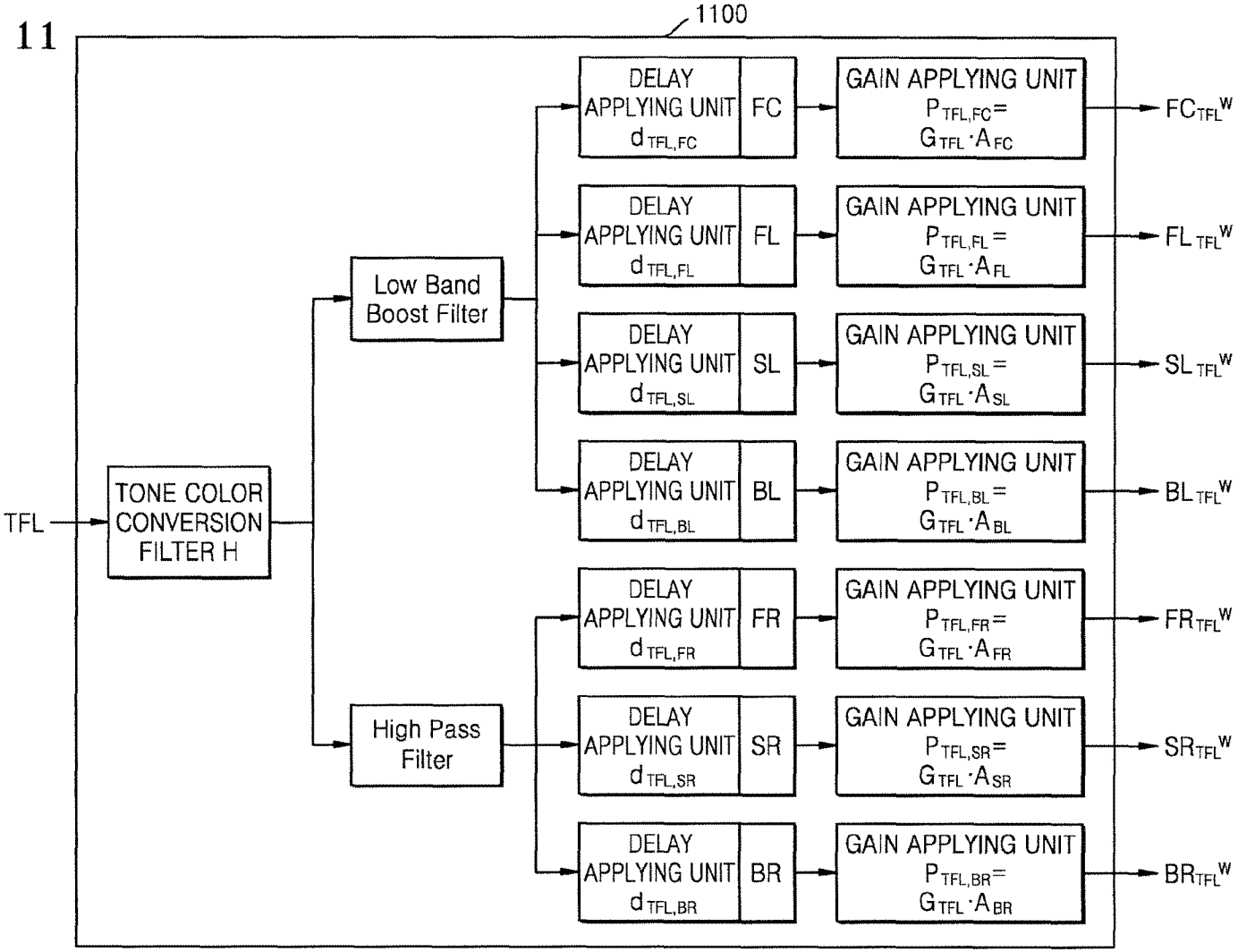

FIGS. 10 and 11 are diagrams illustrating a method of rendering a 11.1-channel audio signal to output the rendered audio signal through a 7.1-channel speaker, according to one or more exemplary embodiments.

First, when the 11.1-channel audio signal having the top front left channel is input, the virtual audio generation unit 920 may apply the input audio signal having the top front left channel to the tone color conversion filter H. Also, the virtual audio generation unit 920 may copy an audio signal, corresponding to the top front left channel to which the tone color conversion filter H is applied, to seven audio signals and then may determine an ipsilateral speaker and a contralateral speaker according to a position of an audio signal having the top front left channel. That is, the virtual audio generation unit 920 may determine, as ipsilateral speakers, speakers respectively corresponding to the front left channel, the surround left channel, and the back left channel located in the same direction as that of the audio signal having the top front left channel, and may determine, as contralateral speakers, speakers respectively corresponding to the front right channel, the surround right channel, and the back right channel located in a direction opposite to that of the audio signal having the top front left channel.

Moreover, the virtual audio generation unit 920 may filter a virtual audio signal corresponding to an ipsilateral speaker among a plurality of copied virtual audio signals by using the low band boost filter. Also, the virtual audio generation unit 920 may input the virtual audio signals passing through the low band boost filter to a plurality of gain applying units respectively corresponding to the front left channel, the surround left channel, and the back left channel and may multiply an audio signal by multichannel panning gain values "$G_{TFL,FL}$, $G_{TFL,SL}$, and $G_{TFL,BL}$" for localizing the audio signal at a position of the top front left channel, thereby generating a 3-channel virtual audio signal.

The virtual audio generation unit 920 may filter a virtual audio signal corresponding to a contralateral speaker among the plurality of copied virtual audio signals by using the high-pass filter. Also, the virtual audio generation unit 920 may input the virtual audio signals passing through the high-pass filter to a plurality of gain applying units respectively corresponding to the front right channel, the surround right channel, and the back right channel and may multiply an audio signal by multichannel panning gain values "$G_{TFL,FR}$, $G_{TFL,SR}$, and $G_{TFL,BR}$" for localizing the audio signal at a position of the top front left channel, thereby generating a 3-channel virtual audio signal.

Moreover, in a virtual audio signal corresponding to a front center channel instead of an ipsilateral speaker or a contralateral speaker, the virtual audio generation unit 920 may process the virtual audio signal corresponding to the front center channel by using the same method as the ipsilateral speaker or the same method as the contralateral speaker. According to an exemplary embodiment, as illustrated in FIG. 10, the virtual audio signal corresponding to the front center channel may be processed by the same method as a virtual audio signal corresponding to the ipsilateral speaker.

In FIG. 10, an exemplary embodiment, in which an audio signal corresponding to the top front left channel among 11.1-channel audio signals is rendered to a virtual audio signal has been described above, but audio signals respectively corresponding to the top front right channel, the top surround left channel, and the top surround right channel giving different senses of elevation among the 11.1-channel audio signals may be rendered by the method described above with reference to FIG. 10.

According to another exemplary embodiment, an audio apparatus 1100 illustrated in FIG. 11 may be implemented by integrating the virtual audio providing method described above with reference to FIG. 6 and the virtual audio providing method described above with reference to FIG. 10. The audio apparatus 1100 may perform tone color conversion on an input audio signal by using the tone color conversion filter H, may filter virtual audio signals corresponding to an ipsilateral speaker by using the low band boost filter for different gain values to be applied to audio signals, and may filter audio signals corresponding to a contralateral speaker by using the high-pass filter according to a frequency, based on the kind of a channel of an audio signal from which a virtual audio signal is to be generated. Also, the audio apparatus 100 may apply a delay value "d" and a final gain value "P" to a plurality of virtual audio signals for the plurality of virtual audio signals to constitute a sound field having a plane wave, thereby generating a virtual audio signal.

Figure 12:
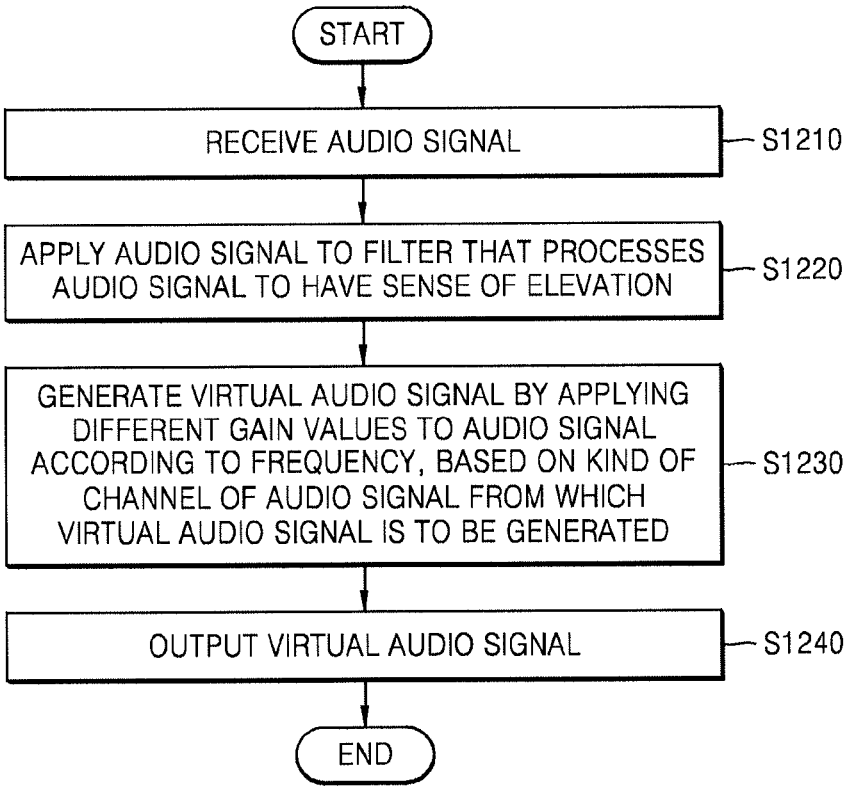
FIG. 12 is a diagram illustrating an audio providing method performed by an audio apparatus, according to another exemplary embodiment.

FIG. 12 is a diagram illustrating an audio providing method performed by the audio apparatus 900, according to another exemplary embodiment.

In operation S1210, the audio apparatus 900 may receive an audio signal. The received audio signal may be a multichannel audio signal (for example, 11.1 channel) giving plural senses of elevation.

In operation S1220, the audio apparatus 900 may apply an audio signal, having a channel giving a sense of elevation among a plurality of channels, to a filter which processes an audio signal to have a sense of elevation. The audio signal having a channel giving a sense of elevation among a plurality of channels may be an audio signal having the top front left channel, and the filter which processes an audio signal to have a sense of elevation may be the HRTF correction filter.

In operation S1230, the audio apparatus 900 may apply different gain values to the audio signal according to a frequency, based on the kind of a channel of an audio signal from which a virtual audio signal is to be generated, thereby generating a plurality of virtual audio signals.

The audio apparatus 900 may copy a filtered audio signal to correspond to the number of speakers and may determine an ipsilateral speaker and a contralateral speaker, based on the kind of the channel of the audio signal from which the virtual audio signal is to be generated. The audio apparatus 900 may apply the low band boost filter to a virtual audio signal corresponding to the ipsilateral speaker, may apply the high-pass filter to a virtual audio signal corresponding to the contralateral speaker, and may multiply, by a panning gain value, an audio signal corresponding to the ipsilateral speaker and an audio signal corresponding to the contralateral speaker to generate a plurality of virtual audio signals.

In operation S1240, the audio apparatus 900 may output the plurality of virtual audio signals.

As described above, the audio apparatus 900 may apply the different gain values to the audio signal according to the frequency, based on the kind of the channel of the audio signal from which the virtual audio signal is to be generated, and thus, a user listens to a virtual audio signal giving a sense of elevation, provided by the audio apparatus 900, at various positions.

Figure 13:
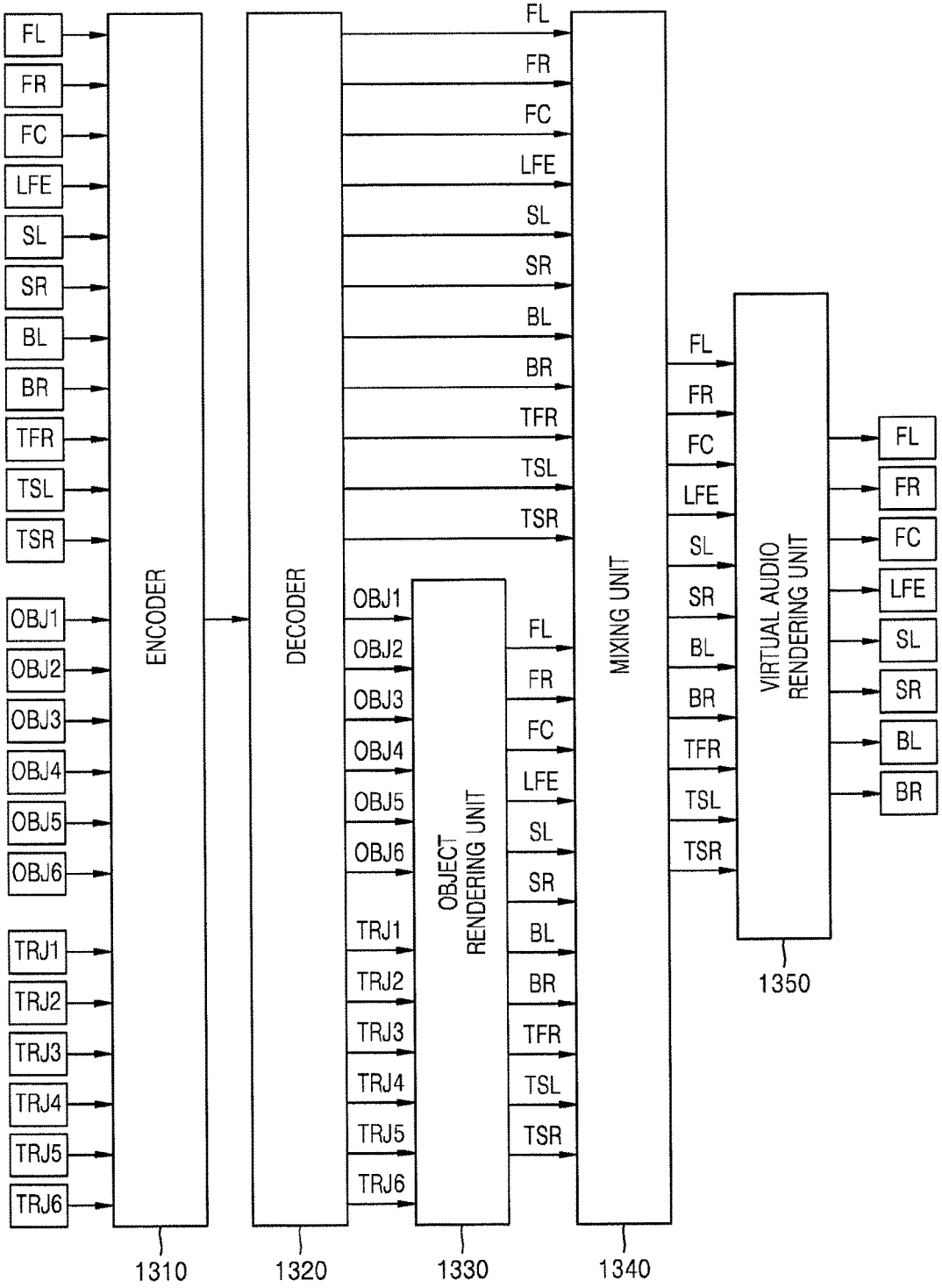
FIG. 13 is a diagram illustrating a related art method of rendering a 11.1-channel audio signal to output the rendered audio signal through a 7.1-channel speaker.

FIG. 13 is a diagram illustrating a related art method of rendering a 11.1-channel audio signal to output the rendered audio signal through a 7.1-channel speaker. First, an encoder 1310 may encode a 11.1-channel channel audio signal, a plurality of object audio signals, and pieces of trajectory information corresponding to the plurality of object audio signals to generate a bitstream. Also, a decoder 1320 may decode a received bitstream to output the 11.1-channel channel audio signal to a mixing unit 1340 and output the plurality of object audio signals and the pieces of trajectory information corresponding thereto to an object rendering unit 1330. The object rendering unit 1330 may render the object audio signals to the 11.1 channel by using the trajectory information and may output object audio signals, rendered to the 11.1 channel, to the mixing unit 1340. The mixing unit 1340 may mix the 11.1-channel channel audio signal with the object audio signals rendered to the 11.1 channel to generate 11.1-channel audio signals and may output the generated 11.1-channel audio signals to the virtual audio rendering unit 1350. As described above with reference to FIGS. 2 to 12, the virtual audio rendering unit 1350 may generate a plurality of virtual audio signals by using audio signals respectively having four channels (for example, the top front left channel, the top front right channel, the top surround left channel, and the top surround right channel) giving different senses of elevation among the 11.1-channel audio signals and may mix the generated plurality of virtual audio signals with the other channels to output a 7.1-channel audio signal.

However, as described above, in a case in which a virtual audio signal is generated by uniformly processing the audio signals having the four channels giving different senses of elevation among the 11.1-channel audio signals, when an audio signal that has a wideband, like applause or the sound of rain, has no inter-channel cross correlation (ICC) (i.e., has a low correlation), and has impulsive characteristic is rendered to a virtual audio signal, a quality of audio is deteriorated. Because a quality of audio is more severely deteriorated when generating a virtual audio signal, a rendering operation of generating a virtual audio signal may be performed through down-mixing based on tone color without being performed for an audio signal having impulsive characteristic, thereby providing better sound quality.

According to an exemplary embodiment, the rendering kind of an audio signal is determined based on rendering information of the audio signal will be described with reference to FIGS. 14 to 16.

Figure 14:
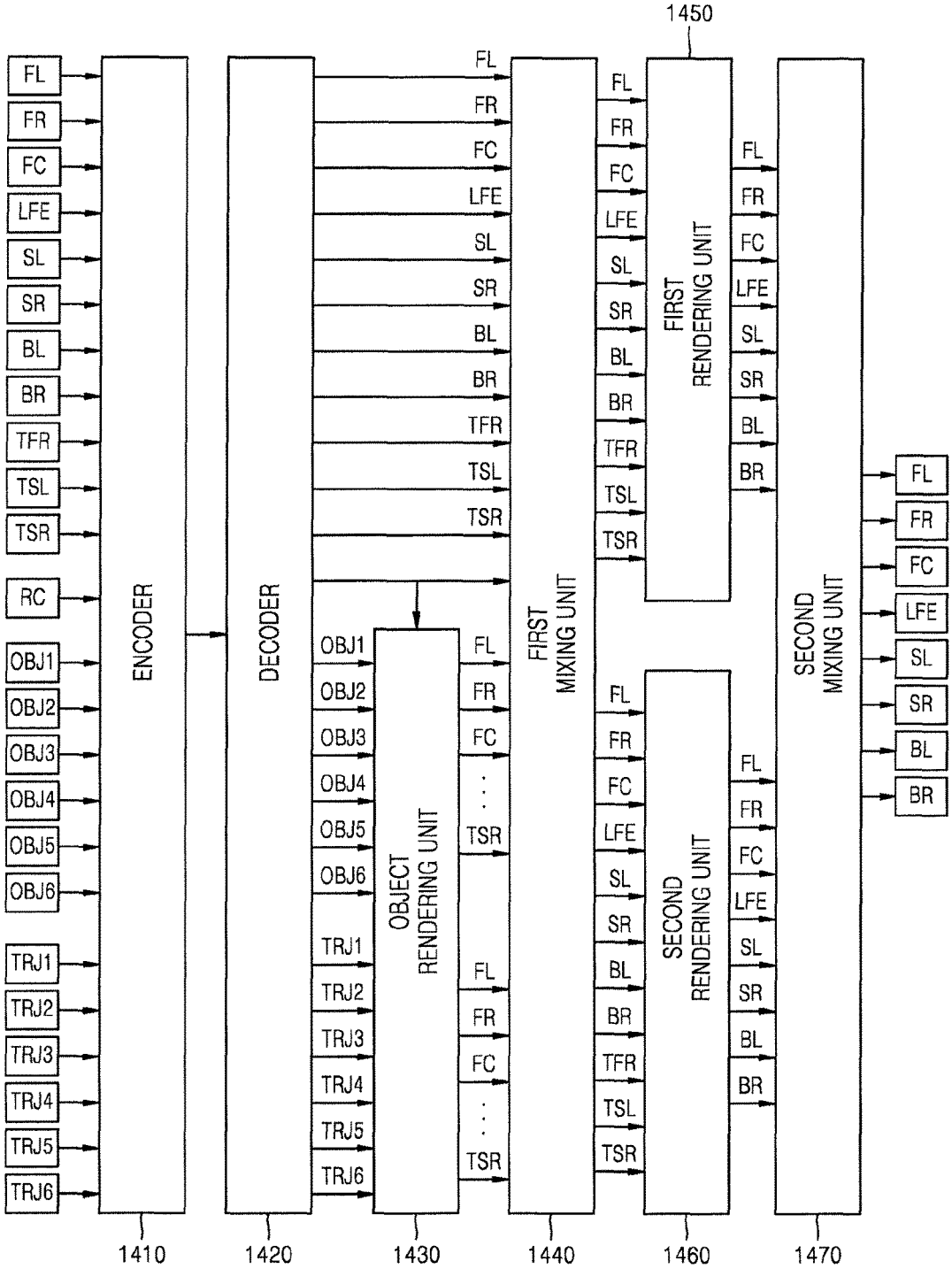
FIGS. 14 to 20 are diagrams illustrating a method of outputting a 11.1-channel audio signal through a 7.1-channel speaker by using a plurality of rendering methods, according to one or more exemplary embodiments.
Figure 15:
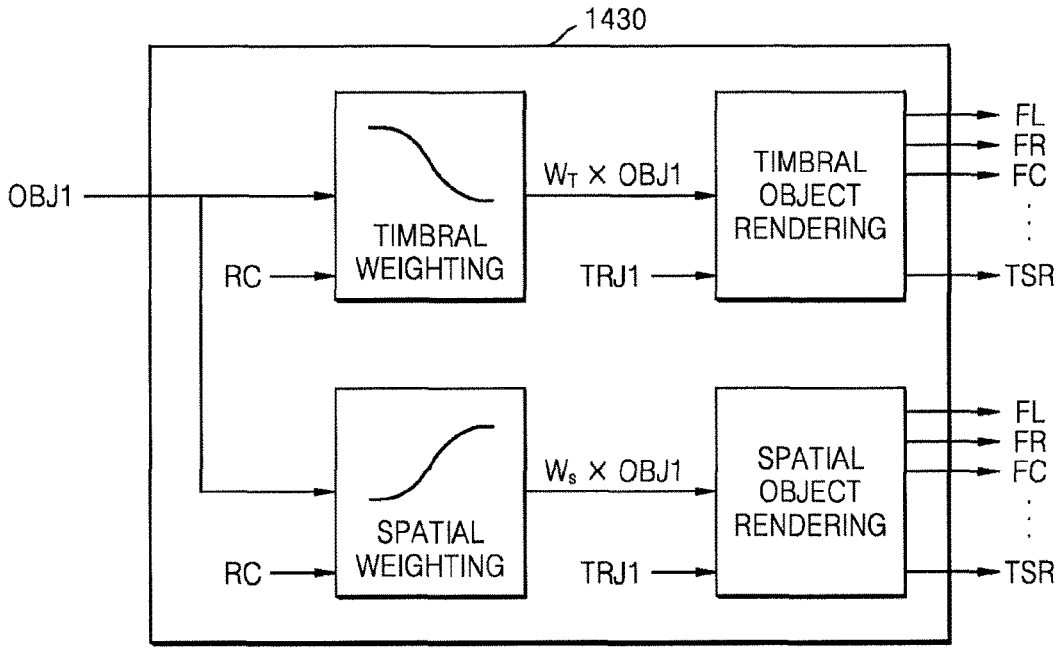

FIG. 14 is a diagram illustrating a method in which an audio apparatus performs different rendering methods on a 11.1-channel audio signal according to rendering information of an audio signal to generate a 7.1-channel audio signal, according to one or more exemplary embodiments.

An encoder 1410 may receive and encode a 11.1-channel channel audio signal, a plurality of object audio signals, trajectory information corresponding to the plurality of object audio signals, and rendering information of an audio signal. The rendering information of the audio signal may denote the kind of the audio signal and may include at least one of information about whether an input audio signal is an audio signal having impulsive characteristic, information about whether the input audio signal is an audio signal having a wideband, and information about whether the input audio signal is low in ICC. Also, the rendering information of the audio signal may include information about a method of rendering an audio signal. That is, the rendering information of the audio signal may include information about which of a timbral rendering method and a spatial rendering method the audio signal is rendered by.

A decoder 1420 may decode an audio signal obtained through the encoding to output the 11.1-channel channel audio signal and the rendering information of the audio signal to a mixing unit 1440 and output the plurality of object audio signals, the trajectory information corresponding thereto, and the rendering information of the audio signal to the mixing unit 1440.

An object rendering unit 1430 may generate a 11.1-channel object audio signal by using the plurality of object audio signals input thereto and the trajectory information corresponding thereto and may output the generated 11.1-channel object audio signal to the mixing unit 1440.

A first mixing unit 1440 may mix the 11.1-channel channel audio signal input thereto with the 11.1-channel object audio signal to generate 11.1-channel audio signals. Also, the first mixing unit 1440 may include a rendering unit that renders the 11.1-channel audio signals generated from the rendering information of the audio signal. The first mixing unit 1440 may determine whether the audio signal is an audio signal having impulsive characteristic, whether the audio signal is an audio signal having a wideband, and whether the audio signal is low in ICC, based on the rendering information of the audio signal. When the audio signal is the audio signal having impulsive characteristic, the audio signal is the audio signal having a wideband, or the audio signal is low in ICC, the first mixing unit 1440 may output the 11.1-channel audio signals to the first rendering unit 1450. On the other hand, when the audio signal does not have the above-described characteristics, the first mixing unit 1440 may output the 11.1-channel audio signals to a second rendering unit 1460.

The first rendering unit 1450 may render four audio signals giving different senses of elevation among the 11.1-channel audio signals input thereto by using the timbral rendering method. The first rendering unit 1450 may render audio signals, respectively corresponding to the top front left channel, the top front right channel, the top surround left channel, and the top surround right channel among the 11.1-channel audio signals, to the front left channel, the front right channel, the surround left channel, and the top surround right channel by using a first channel down-mixing method, and may mix audio signals having four channels obtained through the down-mixing with audio signals having the other channels to output a 7.1-channel audio signal to a second mixing unit 1470.

The second rendering unit 1460 may render four audio signals, which have different senses of elevation among the 11.1-channel audio signals input thereto, to a virtual audio signal giving a sense of elevation by using the spatial rendering method described above with reference to FIGS. 2 to 13.

The second mixing unit 1470 may output the 7.1-channel audio signal which is output through at least one of the first rendering unit 1450 and the second rendering unit 1460.

According to an exemplary embodiment, it has been described above that the first rendering unit 1450 and the second rendering unit 1460 render an audio signal by using at least one of the timbral rendering method and the spatial rendering method. According to one or more exemplary embodiments, the object rendering unit 1430 may render an object audio signal by using at least one of the timbral rendering method and the spatial rendering method, based on rendering information of an audio signal.

According to an exemplary embodiment, it has been described above that rendering information of an audio signal is determined by analyzing the audio signal before encoding. However, for example, rendering information of an audio signal may be generated and encoded by a sound mixing engineer for reflecting an intention of creating content, and may be acquired by various methods.

The encoder 1410 may analyze the plurality of channel audio signals, the plurality of object audio signals, and the trajectory information to generate the rendering information of the audio signal. The encoder 1410 may extract features which are used to classify an audio signal, and may teach the extracted features to a classifier to analyze whether the plurality of channel audio signals or the plurality of object audio signals input thereto have impulsive characteristic. Also, the encoder 1410 may analyze trajectory information of the object audio signals, and when the object audio signals are static, the encoder 1410 may generate rendering information that allows rendering to be performed by using the timbral rendering method. When the object audio signals include a motion, the encoder 1410 may generate rendering information that allows rendering to be performed by using the spatial rendering method. That is, in an audio signal that has an impulsive feature and has static characteristic having no motion, the encoder 1410 may generate rendering information that allows rendering to be performed by using the timbral rendering method, and otherwise, the encoder 1410 may generate rendering information that allows rendering to be performed by using the spatial rendering method. Whether a motion is detected may be estimated by calculating a movement distance per frame of an object audio signal.

When the analysis of which of the timbral rendering method and the spatial rendering method is performed is based on soft decision instead of hard decision, the encoder 1410 may perform rendering by a combination of a rendering operation based on the timbral rendering method and a rendering operation based on the spatial rendering method, based on a characteristic of an audio signal. For example, as illustrated in FIG. 15, when a first object audio signal OBJ1, first trajectory information TRJ1, and a rendering weight value RC which the encoder 1410 analyzes a characteristic of an audio signal to generate are input, the object rendering unit 1430 may determine a weight value $W_T$ for the timbral rendering method and a weight value $W_S$ for the spatial rendering method by using the rendering weight value RC. Also, the object rendering unit 1430 may multiply the input first object audio signal OBJ1 by the weight value $W_T$ for the timbral rendering method to perform rendering based on the timbral rendering method, and may multiply the input first object audio signal OBJ1 by the weight value $W_S$ for the spatial rendering method to perform rendering based on the spatial rendering method. Also, as described above, the object rendering unit 1430 may perform rendering on the other object audio signals.

Figure 16:
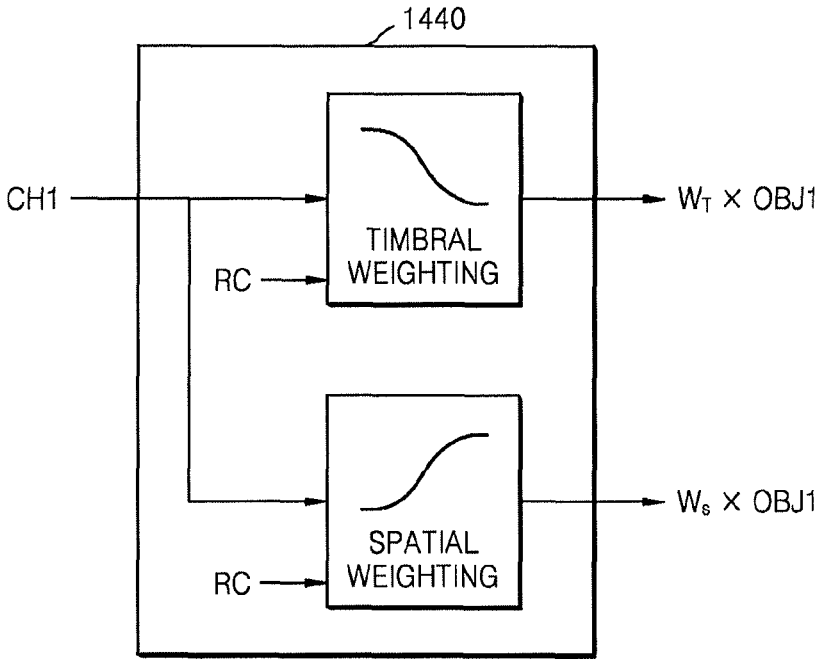

As another example, as illustrated in FIG. 16, when a first channel audio signal CH1 and the rendering weight value RC which the encoder 1410 analyzes the characteristic of the audio signal to generate are input, the first mixing unit 1440 may determine the weight value $W_T$ for the timbral rendering method and the weight value $W_S$ for the spatial rendering method by using the rendering weight value RC. Also, the first mixing unit 1440 may multiply the input first channel audio signal CH1 by the weight value $W_T$ for the timbral rendering method to output a value obtained through the multiplication to the first rendering unit 1450, and may multiply the input first channel audio signal CH1 by the weight value $W_S$ for the spatial rendering method to output a value obtained through the multiplication to the second rendering unit 1460. The first mixing unit 1440 may multiply the other channel audio signals by a weight value to respectively output values obtained through the multiplication to the first rendering unit 1450 and the second rendering unit 1460.

According to an exemplary embodiment, it has been described above that the encoder 1410 acquires rendering information of an audio signal. According to one or more exemplary embodiments, the decoder 1420 may acquire the rendering information of the audio signal. The encoder 1410 may not transmit the rendering information, and the decoder 1420 may directly generate the rendering information.

Moreover, according to another exemplary embodiment, the decoder 1420 may generate rendering information that allows a channel audio signal to be rendered using the timbral rendering method and allows an object audio signal to be rendered by using the spatial rendering method.

As described above, a rendering operation may be performed by different methods according to rendering information of an audio signal, and sound quality is prevented from being deteriorated due to a characteristic of the audio signal.

Below, a method of determining a rendering method of a channel audio signal by analyzing the channel audio signal when an object audio signal is not separated and there is only the channel audio signal for which all audio signals are rendered and mixed will be described. A method that analyzes an object audio signal to extract an object audio signal component from a channel audio signal, performs rendering, providing a virtual sense of elevation, on the object audio signal by using the spatial rendering method, and performs rendering on an ambience audio signal by using the timbral rendering method will be described below.

Figure 17:
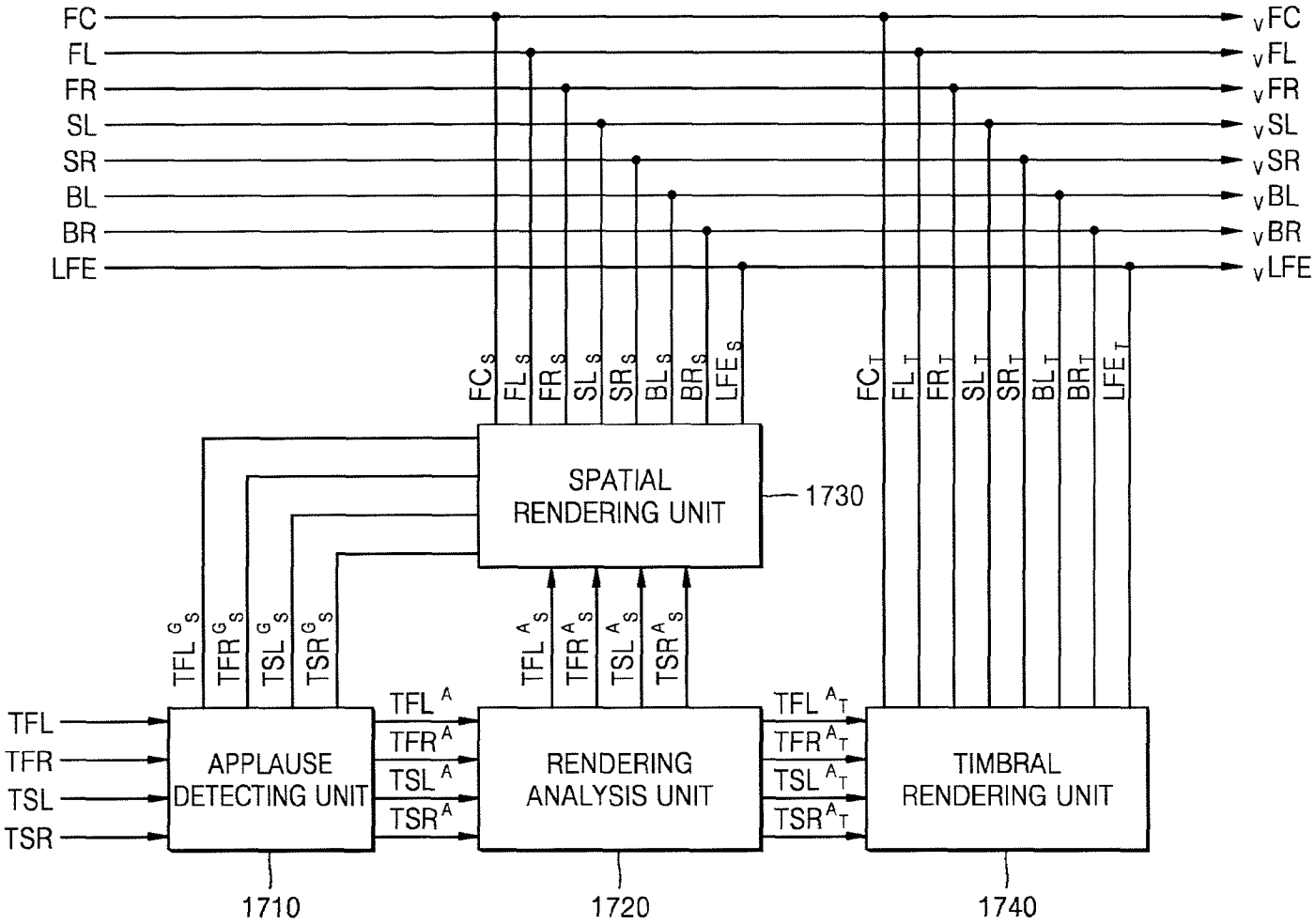

FIG. 17 is a diagram illustrating an exemplary embodiment in which rendering is performed by different methods according to whether applause is detected from four top audio signals giving different senses of elevation in 11.1 channel.

First, an applause detecting unit 1710 (e.g., applause detector) may determine whether applause is detected from the four top audio signals giving different senses of elevation in the 11.1 channel.

In a case in which the applause detecting unit 1710 uses the hard decision, the applause detecting unit 1710 may determine the following output signal.

When applause is detected: $TFL^A$=TFL, $TFR^A$=TFR, $TSL^A$=TSL, $TSR^A$=TSR, $TFL^G$=0, $TFR^G$=0, $TSL^G$=0, $TSR^G$=0

When applause is not detected: $TFL^A$=0, $TFR^A$=0, $TSL^A$=0, $TSR^A$=0, $TFL^G$=TFL, $TFR^G$=TFR, $TSL^G$=TSL, $TSR^G$=TS An output signal may be calculated by an encoder instead of the applause detecting unit 1710 and may be transmitted in the form of flags.

In a case in which the applause detecting unit 1710 uses the soft decision, the applause detecting unit 1710 may multiply a signal by weight values "α and β" to determine the output signal, based on whether applause is detected and an intensity of the applause.

$TFL^A=\alpha_{TFL}TFL$, $TFR^A=\alpha_{TFR}TFR$, $TSL^A=\alpha_{TSL}TSL$, $TSR^A=\alpha_{TSR}TSR$, $TFL^G=\beta_{TFL}TFL$, $TFR^G=\beta_{TFR}TFR$, $TSL^G=\beta_{TSL}TSL$, $TSR^G=\beta_{TSR}TSR$ Signals "$TFL^G$, $TFR^G$, $TSL^G$ and $TSR^G$" among output signals may be output to a spatial rendering unit 1730 (e.g., spatial renderer) and may be rendered by the spatial rendering method.

Signals "$TFL^A$, $TFR^A$, $TSL^A$ and $TSR^A$" among the output signals may be determined as applause components and may be output to a rendering analysis unit 1720 (e.g., rendering analyzer).

Figure 18:
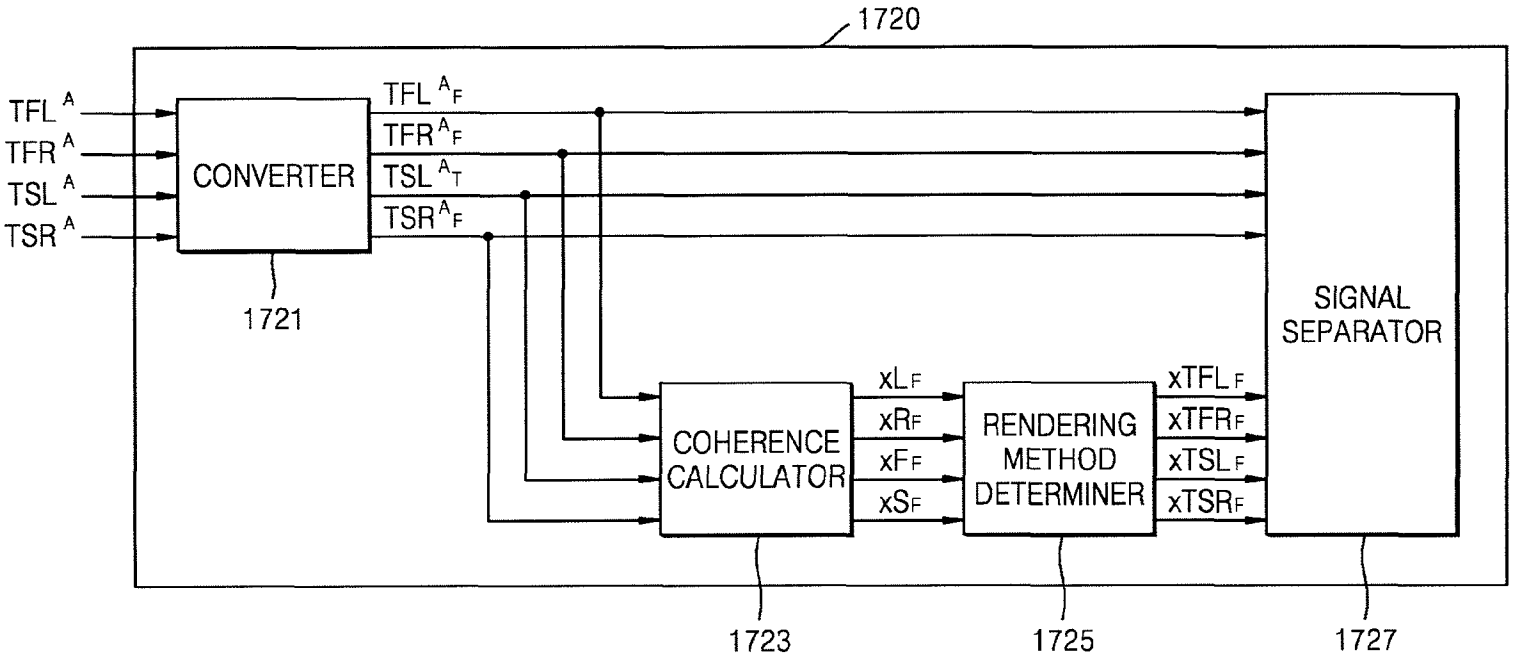

A method in which the rendering analysis unit 1720 determines an applause component and analyzes a rendering method will be described with reference to FIG. 18. The rendering analysis unit 1720 may include a frequency converter 1721, a coherence calculator 1723, a rendering method determiner 1725, and a signal separator 1727.

The frequency converter 1721 may convert the signals "$TFL^A$, $TFR^A$, $TSL^A$ and $TSR^A$" input thereto into frequency domains to output signals "$TFL^A_F$, $TFR^A_F$, $TSL^A_F$ and $TSR^A_F$". The frequency converter 1721 may represent signals as sub-band samples of a filter bank such as quadrature mirror filterbank (QMF) and then may output the signals "$TFL^A_F$, $TFR^A_F$, $TSL^A_F$ and $TSR^A_F$".

The coherence calculator 1723 may calculate a signal "$xL_F$" that is coherence between the signals "$TFL^A_F$ and $TSL^A_F$", a signal "$xR_F$" that is coherence between the signals "$TFR^A_F$ and $TSR^A_F$", a signal "$xF_F$" that is coherence between the signals "$TFL^A_F$ and $TFR^A_F$", and a signal "$xS_F$" that is coherence between the signals "$TSL^A_F$ and $TSR^A_F$", for each of a plurality of bands. When one of two signals is 0, the coherence calculator 1723 may calculate coherence as 1. This is because the spatial rendering method is used when a signal is localized at only one channel.

The rendering method determiner 1725 may calculate weight values "$wTFL_F$, $wTFR_F$, $wTSL_F$ and $wTSR_F$", which are to be used for the spatial rendering method, from the coherences calculated by the coherence calculator 1723 as expressed in the following Equation:

$$wTFL_F=\text{mapper}(\max(xL_F, xF_F))$$

$$wTFR_F=\text{mapper}(\max(xR_F, xF_F))$$

$$wTSL_F=\text{mapper}(\max(xL_F, xS_F))$$

$$wTSR_F=\text{mapper}(\max(xR_F, xS_F))$$

in which max denotes a function that selects a larger number from two coefficients, and mapper denote various types of functions that map a value between 0 and 1 to a value between 0 and 1 through nonlinear mapping.

Figure 19:
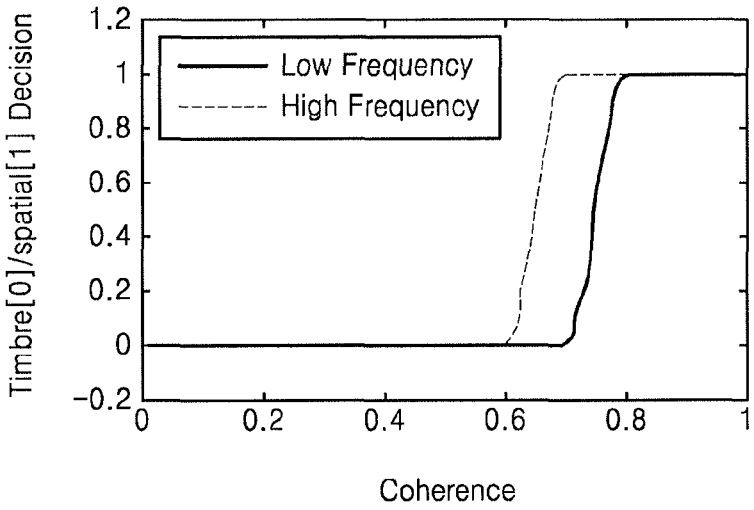

The rendering method determiner 1725 may use different mappers for each of a plurality of frequency bands. Signals are mixed because signal interference caused by delay becomes more severe and a bandwidth becomes broader at a high frequency, and thus, when different mappers are used for each band, sound quality and a degree of signal separation are more enhanced than a case in which the same mapper is used at all bands. FIG. 19 is a graph showing a characteristic of a mapper when the rendering method determiner 1725 uses mappers having different characteristics for each frequency band.

Figure 20:
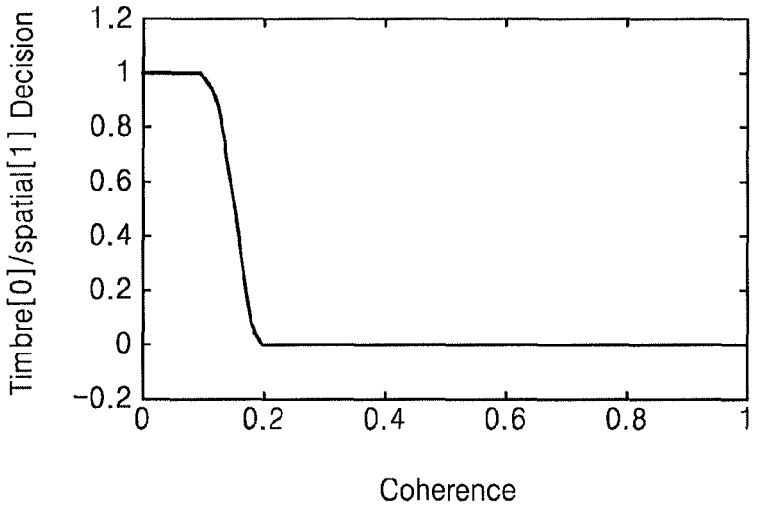

When there is no one signal (i.e., when a similarity function value is 0 or 1, and panning is made at only one side), the coherence calculator 1723 may calculate coherence as 1. However, because a signal corresponding to a side lobe or a noise floor caused by conversion to a frequency domain is generated, when the similarity function value has a similarity value equal to or less than a threshold value by setting the threshold value (for example, 0.1) therein, the spatial rendering method may be selected, thereby preventing noise from occurring. FIG. 20 is a graph for determining a weight value for a rendering method according to a similarity value. For example, when a similarity function value is equal to or less than 0.1, a weight value may be set to select the spatial rendering method.

The signal separator 1727 may multiply the signals "$TFL^A_F$, $TFR^A_F$, $TSL^A_F$ and $TSR^A_F$", which are converted into the frequency domains, by the weight values "$wTFL_F$, $wTFR_F$, $wTSL_F$ and $wTSR_F$" determined by the rendering method determiner 1725 to convert signals "$TFL^A_F$, $TFR^A_F$, $TSL^A_F$ and $TSR^A_F$" into the frequency domains and then may output signals "$TFL^A_S$, $TFR^A_S$, $TSL^A_S$ and $TSR^A_S$" to the spatial rendering unit 1730.

The signal separator 1727 may output, to a timbral rendering unit 1740, signals "$TFL^A_T$, $TFR^A_T$, $TSL^A_T$ and $TSR^A_T$" obtained by subtracting the signals "$TFL^A_S$, $TFR^A_S$, $TSL^A_S$ and $TSR^A_S$", output to the spatial rendering unit 1730, from the signals "$TFL^A_F$, $TFR^A_F$, $TSL^A_F$ and $TSR^A_F$" input thereto.

As a result, the signals "$TFL^A_S$, $TFR^A_S$, $TSL^A_S$ and $TSR^A_S$" output to the spatial rendering unit 1730 may constitute signals corresponding to objects localized to four top channel audio signals, and the signals "$TFL^A_T$, $TFR^A_T$, $TSL^A_T$ and $TSR^A_T$" output to the timbral rendering unit 1740 may constitute signals corresponding to diffused sounds.

Therefore, when an audio signal such as applause or a sound of rain which is low in coherence between channels is rendered by at least one of the timbral rendering method and the spatial rendering method through the above-described process, an incidence of sound-quality deterioration is minimized.

A multichannel audio codec may use an ICC for compressing data like MPEG surround. A channel level difference (CLD) and the ICC may be mostly used as parameters. MPEG spatial audio object coding (SAOC) that is object coding technology may have a form similar thereto. An internal coding operation may use channel extension technology that extends a signal from a down-mix signal to a multichannel audio signal.

Figure 21:
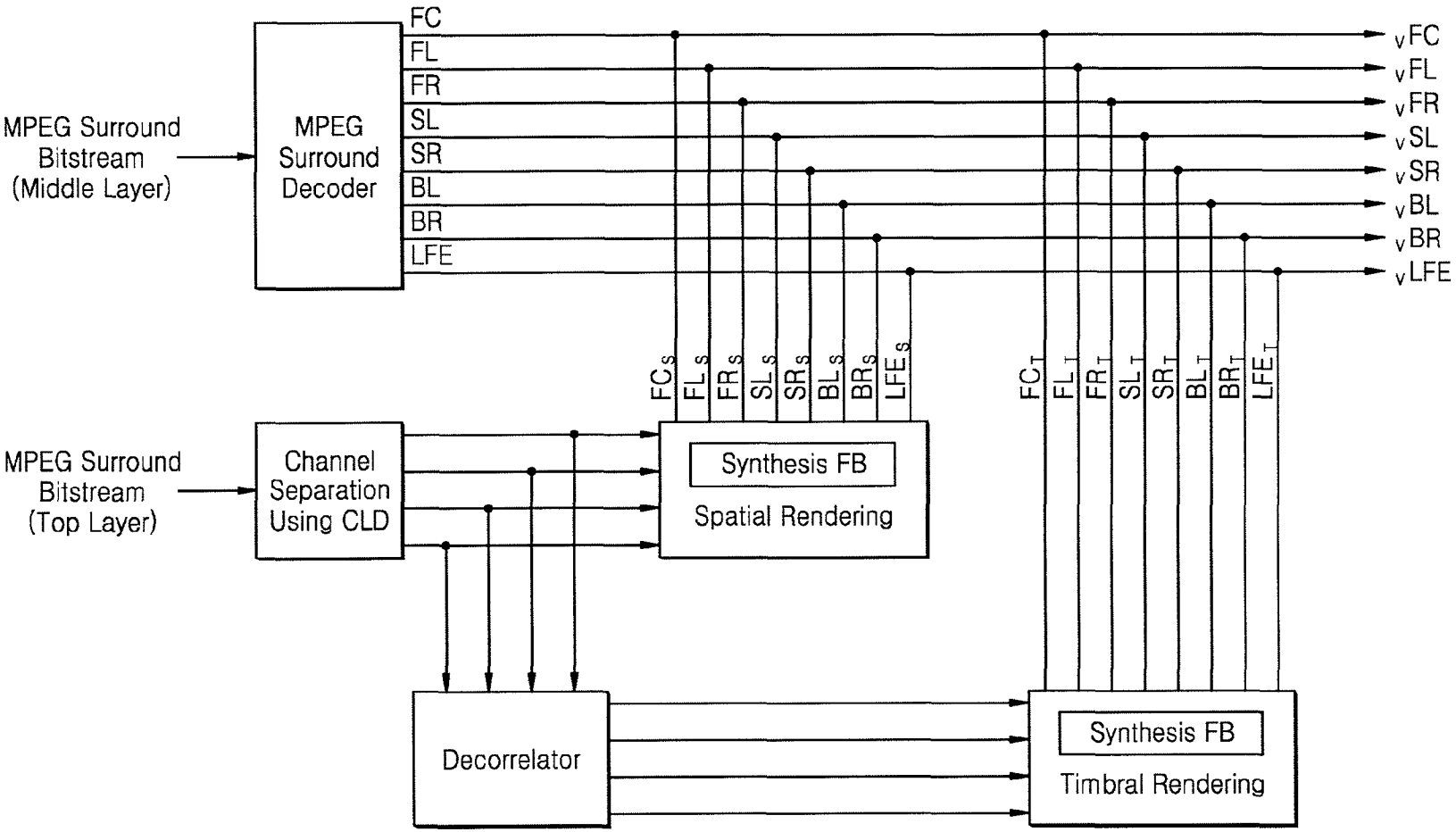
FIG. 21 is a diagram illustrating an exemplary embodiment in which rendering is performed by using a plurality of rendering methods when a channel extension codec having a structure such as MPEG surround is used, according to an exemplary embodiment.

FIG. 21 is a diagram illustrating an exemplary embodiment in which rendering is performed by using a plurality of rendering methods when a channel extension codec having a structure such as MPEG surround is used, according to an exemplary embodiment.

A decoder of a channel codec may separate a channel of a bitstream corresponding to a top-layer audio signal, based on a CLD, and then a de-correlator may correct coherence between channels, based on ICC. As a result, a dried channel sound source and a diffused channel sound source may be separated from each other and output. The dried channel sound source may be rendered by the spatial rendering method, and the diffused channel sound source may be rendered by the timbral rendering method.

To efficiently use the present structure, the channel codec may separately compress and transmit a middle-layer audio signal and the top-layer audio signal, or in a tree structure of a one-to-two/two-to-three (OTT/TTT) box, the middle-layer audio signal and the top-layer audio signal may be separated from each other and then may be transmitted by compressing separated channels.

Applause may be detected for channels of top layers and may be transmitted as a bitstream. A decoder may render a sound source, of which a channel is separated based on the CLD, by using the spatial rendering method in an operation of calculating signals "$TFL^A$, $TFR^A$, $TSL^A$ and $TSR^A$" that are channel data equal to applause. In a case in which filtering, weighting, and summation that are operational factors of spatial rendering are performed in a frequency domain, multiplication, weighting, and summation may be performed, and thus, the filtering, weighting, and summation may be performed without adding a number of operations. Also, in an operation of rendering a diffused sound source generated based on the ICC by using the timbral rendering method, rendering may be performed through weighting and summation, and thus, spatial rendering and timbral rendering may be performed by adding a small number of operations.

Below, a multichannel audio providing system according to one or more exemplary embodiments will be described with reference to FIGS. 22 to 25. FIGS. 22 to 25 illustrate a multichannel audio providing system that provides a virtual audio signal giving a sense of elevation by using speakers located on the same plane.

Figure 22:
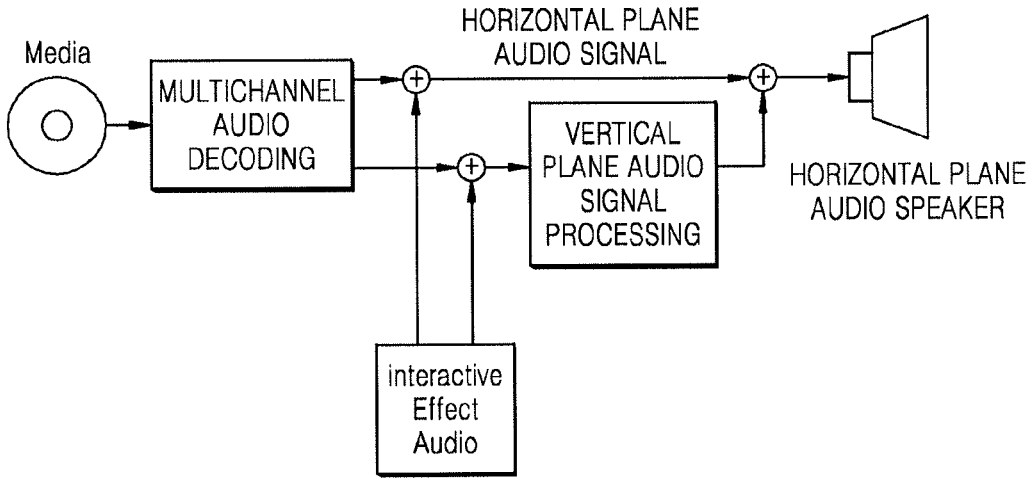
FIGS. 22 to 25 are diagrams illustrating a multichannel audio providing system according to one or more exemplary embodiments.

FIG. 22 is a diagram illustrating a multichannel audio providing system according to an exemplary embodiment.

An audio apparatus may receive a multichannel audio signal from a media. The audio apparatus may decode the multichannel audio signal and may mix a channel audio signal, which corresponds to a speaker in the decoded multichannel audio signal, with an interactive effect audio signal output from the outside to generate a first audio signal.

The audio apparatus may perform vertical plane audio signal processing on channel audio signals giving different senses of elevation in the decoded multichannel audio signal. The vertical plane audio signal processing may be an operation of generating a virtual audio signal giving a sense of elevation by using a horizontal plane speaker and may use the above-described virtual audio signal generation technology.

The audio apparatus may mix a vertical-plane-processed audio signal with the interactive effect audio signal output from the outside to generate a second audio signal.

The audio apparatus may mix the first audio signal with the second audio signal to output a signal, obtained through the mixing, to a corresponding horizontal plane audio speaker.

Figure 23:
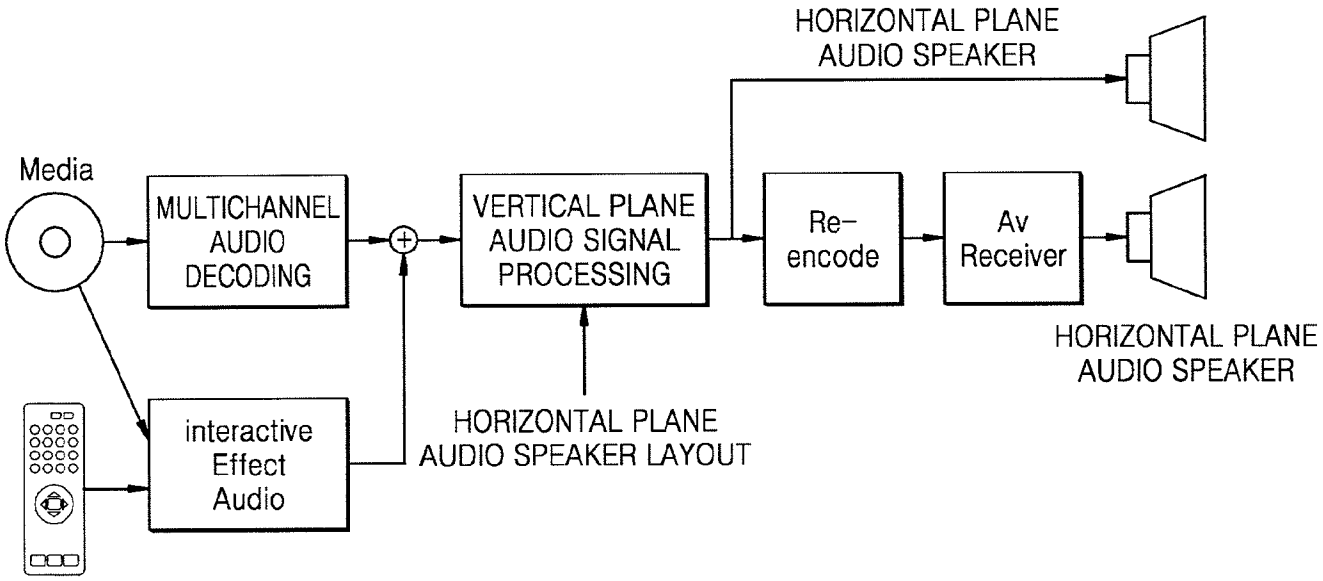

FIG. 23 is a diagram illustrating a multichannel audio providing system according to an exemplary embodiment.

First, an audio apparatus may receive a multichannel audio signal from a media. Also, the audio apparatus may mix the multichannel audio signal with an interactive effect audio signal output from the outside to generate a first audio signal.

The audio apparatus may perform vertical plane audio signal processing on the first audio signal to correspond to a layout of a horizontal plane audio speaker and may output a signal, obtained through the processing, to a corresponding horizontal plane audio speaker.

The audio apparatus may encode the first audio signal for which the vertical plane audio signal processing has been performed, and may transmit an audio signal, obtained through the encoding, to an external audio video (AV)-receiver. The audio apparatus may encode an audio signal in a format, which is supportable by the existing AV-receiver, such as a Dolby digital format, a DTS format, and the like.

The external AV-receiver may process the first audio signal for which the vertical plane audio signal processing has been performed, and may output an audio signal, obtained through the processing, to a corresponding horizontal plane audio speaker.

Figure 24:
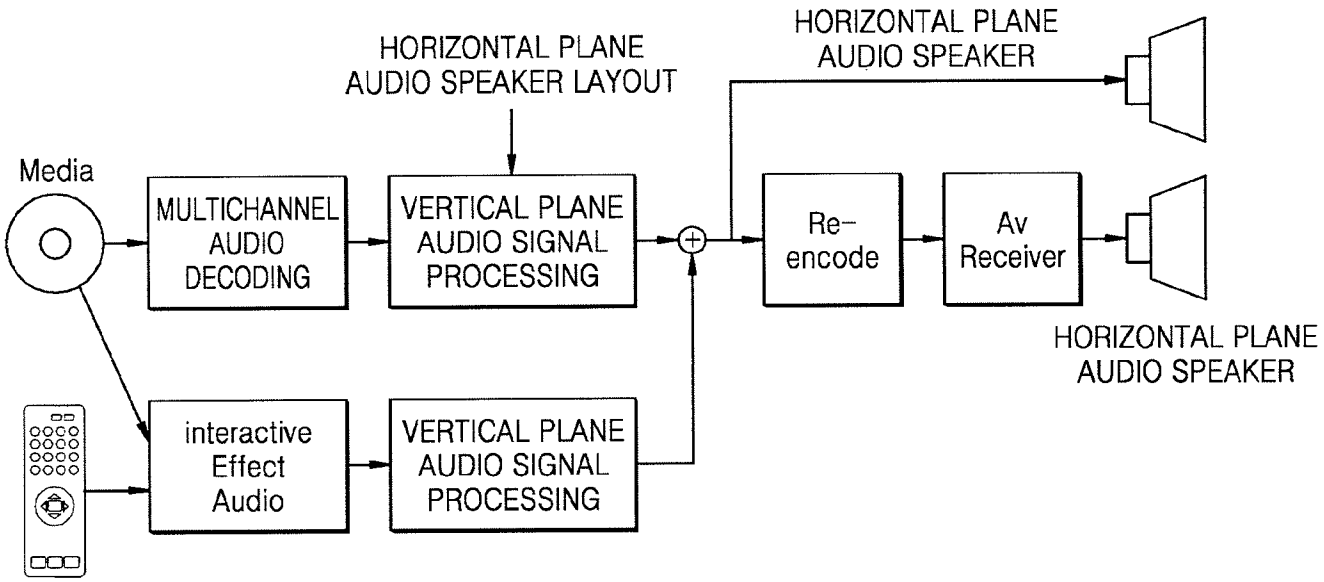

FIG. 24 is a diagram illustrating a multichannel audio providing system according to an exemplary embodiment.

An audio apparatus may receive a multichannel audio signal from a media and may receive an interactive effect audio signal output from the outside (e.g., a remote controller).

The audio apparatus may perform vertical plane audio signal processing on the received multichannel audio signal to correspond to a layout of a horizontal plane audio speaker and may also perform vertical plane audio signal processing on the received interactive effect audio signal to correspond to a speaker layout.

The audio apparatus may mix the multichannel audio signal and the interactive effect audio signal, for which the vertical plane audio signal processing has been performed, to generate a first audio signal and may output the first audio signal to a corresponding horizontal plane audio speaker.

The audio apparatus may encode the first audio signal and may transmit an audio signal, obtained through the encoding, to an external AV-receiver. The audio apparatus may encode an audio signal in a format, which is supportable by the existing AV-receiver, like a Dolby digital format, a DTS format, or the like.

Then external AV-receiver may process the first audio signal for which the vertical plane audio signal processing has been performed, and may output an audio signal, obtained through the processing, to a corresponding horizontal plane audio speaker.

Figure 25:
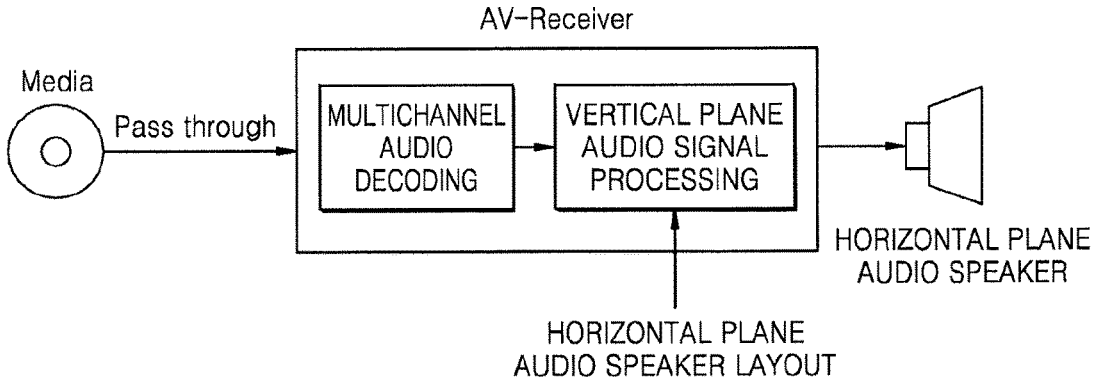

FIG. 25 is a diagram illustrating a multichannel audio providing system according to an exemplary embodiment.

An audio apparatus may immediately transmit a multichannel audio signal, input from a media, to an external AV-receiver.

The external AV-receiver may decode the multichannel audio signal and may perform vertical plane audio signal processing on the decoded multichannel audio signal to correspond to a layout of a horizontal plane audio speaker.

The external AV-receiver may output the multichannel audio signal, for which the vertical plane audio signal processing has been performed, through a horizontal plane speaker.

It should be understood that exemplary embodiments described herein should be considered in a descriptive sense and not for purposes of limitation. Descriptions of features or aspects within one or more exemplary embodiments should be considered as available for other similar features or aspects in other exemplary embodiments. While one or more exemplary embodiments have been described with reference to the figures, it will be understood by those of ordinary skill in the art that various changes in form and details may be made therein without departing from the spirit and scope as defined by the following claims.

What is claimed is:

1. A method of rendering an audio signal, the method comprising:

receiving a plurality of input channel signals including a height input channel signal;

identifying an output layout of two dimensions, wherein the output layout is formed of a plurality of output channel signals;

obtaining a type of filter based on a position of the height input channel signal;

obtaining a set of panning gains based on a frequency range and the position of the height input channel signal; and generating the plurality of output channel signals by elevation rendering the plurality of input channel signals, based on the type of filter and the set of panning gains, to provide elevated sound images, wherein the position of the height input channel signal comprises elevation information and azimuth information, and wherein the set of panning gains is comprised a first group or a second group according to the frequency range.

2. The method of claim 1, wherein the plurality of output channel signals are horizontal channel signals.

3. The method of claim 1, wherein the height input channel signal is used to generate at least one of the plurality of output channel signals.

4. An apparatus for rendering an audio signal, the apparatus comprising:

a receiving unit configured to receive a plurality of input channel signals including a height input channel signal;

an obtaining unit configured to identify an output layout of two dimensions, wherein the output layout is formed of a plurality of output channel signals, obtain a type of filter based on a position of the height input channel signal, and obtain a set of panning gains based on a frequency range and the position of the height input channel signal; and a rendering unit configured to generate the plurality of output channel signals by elevation rendering the plurality of input channel signals, based on the type of filter and the set of panning gains, to provide elevated sound images, wherein the position of the height input channel signal comprises elevation information and azimuth information, and wherein the set of panning gains is comprised a first group or a second group according to the frequency range.

* * * * *